US006082224A

United States Patent [19]

McDaniels et al.

[11] Patent Number: 6,082,224

[45] Date of Patent: Jul. 4, 2000

[54] POWER TONG

[75] Inventors: Gary McDaniels; Patrick Cummings; Michael Hayes, all of Lafayette, La.; Steven Albright, Houston, Tex.; Bernd G. Pietras, Wedemark, Germany; Jorg Schulze-Beckinghausen, Garbsen, Germany; Andreas Carlsson, Sehnde, Germany

[73] Assignee: Weatherford/Lamb, Inc., Houston, Tex.

[21] Appl. No.: 08/802,629

[22] Filed: Feb. 19, 1997

[30] Foreign Application Priority Data

| | | | |
|---|---|---|---|
| Jan. 29, 1997 | [GB] | United Kingdom | 9701758 |
| Jan. 29, 1997 | [GB] | United Kingdom | 9701939 |
| Feb. 7, 1997 | [GB] | United Kingdom | 9702474 |

[51] Int. Cl.[7] ..... B25B 17/00

[52] U.S. Cl. ..... 81/57.15; 81/57.18; 81/57.2

[58] Field of Search ..... 81/57.15, 57.33, 81/57.16, 57.34, 57.17, 57.18, 57.2, 57.21, 57.11, 54

[56] References Cited

U.S. PATENT DOCUMENTS

| | | |
|---|---|---|
| 1,489,645 | 4/1924 | Mendenhall . |
| 1,719,533 | 7/1929 | Cady . |

(List continued on next page.)

FOREIGN PATENT DOCUMENTS

| | | |
|---|---|---|
| 245968 | 3/1911 | Austria . |
| 2393925 | 1/1979 | France . |
| 43 33513 | of 1995 | Germany . |
| 1060644 | 3/1967 | United Kingdom . |
| 1350171 | 4/1974 | United Kingdom . |
| 1364388 | 8/1974 | United Kingdom . |
| 1393618 | 5/1975 | United Kingdom . |
| WO 94 01249 | 1/1994 | WIPO . |

OTHER PUBLICATIONS

Clincher Chromemaster, Superior Manufacturing & Hydraulics, Inc. 1996.

Clincher Hydraulic Power Tongs & Back Up, Superior Manufacturing & Hydraulics, Inc. 1996.

Hydraulic Power Tongs Operation and Service Instructions, Eckel Mfg. Col, 1979.

Power Pipe Handling Systems and Tongs, Byron Jackson, Inc., Prior to 1996.

Clincher, Superior Manufacturing & Hydraulics, Inc., Jan. 1997.

The Complete Line of Bucking Units, Ray's Quality Machine Works, Inc., prior to 1996.

Varco Oil Tools, Varco, Inc., pp. 5–9, Composite Catalog, 1982–83.

(List continued on next page.)

*Primary Examiner*—David A. Scherbel
*Assistant Examiner*—Joni B. Danganan
*Attorney, Agent, or Firm*—Guy McClung

[57] ABSTRACT

A new power tong for rotating tubular members for make-up (connection) and break-out (disconnection) operations. In one aspect such a tong has at least one movable jaw with a smooth surface gripping element thereon and pre-load apparatus for applying a pre-load force to a movable jaw so that the jaw does not slip on a tubular to be rotated and so it does not mark or damage the tubular. In one aspect the pre-load apparatus includes a first pre-load device at one end of a movable jaw for breakout operations and a second pre-load device at another end of the jaw for make-up operations. In one aspect a power tong which has unique smooth surfaced jaw inserts made, e.g., of aluminum. In one aspect a single pivotable pre-load cylinder, fixed to rotary, pivots for pivotable connection to one jaw or the other. This can be done manually or a powered smaller piston/cylinder may be used to pivot the pre-load cylinder. In one aspect a jaw unit which comprises a jaw holder and a jaw movable with respect to said jaw holder, characterized in that said jaw is slidably mounted on said jaw holder.

16 Claims, 18 Drawing Sheets

U.S. PATENT DOCUMENTS 2,287,432 6/1942 Kinzbach .
2,305,624 12/1942 Lange et al. .
2,305,637 12/1942 Ricciardi .
2,507,127 5/1950 True .
2,550,045 4/1951 DeHetre .
2,618,468 11/1952 Lundeen .
2,703,221 3/1955 Gardner .
2,741,460 4/1956 Gardner .
2,846,909 8/1958 Mason .
2,962,919 12/1960 Grundmann et al. .
3,015,142 1/1962 Rosanoff et al. .
3,019,680 2/1962 Daugherty et al. .
3,021,149 2/1962 Griffin .
3,021,739 2/1962 Grundmann .
3,023,651 3/1962 Wallace .
3,043,619 7/1962 George et al. .
3,140,624 7/1964 George .
3,261,241 7/1966 Catland .
3,272,038 9/1966 Burstall .
3,371,562 3/1968 Kelley .
3,371,728 3/1968 Crooke .
3,531,836 10/1970 Crickmer .
3,589,742 6/1971 Flick .
3,747,675 7/1973 Brown .
3,799,010 3/1974 Guier .
3,847,040 11/1974 Bufkin .
3,875,826 4/1975 Dreyfuss et al. .
3,892,140 7/1975 Fox et al. .
3,906,820 9/1975 Hauk .
4,082,017 4/1978 Eckel .
4,084,453 4/1978 Eckel .
4,099,429 7/1978 Hauk .
4,125,040 11/1978 True .
4,158,974 6/1979 Yamashita .
4,192,206 3/1980 Schulze-Beckinghausen .
4,212,577 7/1980 Swanson .
4,273,010 6/1981 Farr et al. .
4,290,304 9/1981 Eckel .
4,304,433 12/1981 Langowski .
4,315,447 2/1982 Tartaglia et al. .
4,333,365 6/1982 Perry .
4,401,000 8/1983 Kinzbach .
4,402,239 9/1983 Mooney .
4,404,876 9/1983 Eckel .
4,423,647 1/1984 Toelke .
4,437,363 3/1984 Haynes .
4,492,134 1/1985 Reinholdt et al. .
4,576,067 3/1986 Buck .
4,631,987 12/1986 Buck .
4,649,777 3/1987 Buck .
4,688,453 8/1987 Schulze-Beckinghausen .
4,697,830 10/1987 Wood et al. .
4,709,599 12/1987 Buck .
4,712,284 12/1987 Coyle, Sr. et al. .
4,727,781 3/1988 Yuehui et al. .
4,739,681 4/1988 Pietras .
4,774,860 10/1988 Hawke .
4,827,808 5/1989 Haynes et al. .
4,836,064 6/1989 Slator .
5,042,601 8/1991 Penisson .
5,044,232 9/1991 Schulze-Beckinghausen .
5,081,888 1/1992 Schulze-Beckinghausen .
5,099,725 3/1992 Bouligny, Jr. et al. .
5,150,642 9/1992 Moody et al. .
5,159,860 11/1992 Pietras .
5,161,438 11/1992 Pietras .
5,161,439 11/1992 Wesch, Jr. .
5,167,173 12/1992 Pietras .
5,172,613 12/1992 Wesch, Jr. .
5,207,128 5/1993 Albright .
5,221,099 6/1993 Jansch .
5,245,877 9/1993 Ruark .
5,259,275 11/1993 Schulze-Bechinghausen .
5,390,568 2/1995 Pietras .
5,451,084 9/1995 Jansch .
5,479,964 1/1996 Burigana .
5,484,222 1/1996 Schulze-Beckinghausen .
5,535,645 7/1996 Penisson .
5,669,653 9/1997 Pennison .
5,671,961 9/1997 Buck .
5,740,702 4/1998 Smith .
5,746,276 5/1998 Stuart .
5,842,390 12/1998 Bouligny et al. .
5,845,549 12/1998 Bouligny .
5,848,647 12/1998 Webre et al. .
5,850,766 12/1998 Stokes .

OTHER PUBLICATIONS

Joy Petroleum Equipment Catalog, 1978–79, Joy Mfg. Co., 1978.
Peck–O–Matic, The Revolutionary Concept In Power Tongs, Peck–O–Matic, Inc., prior to 1996.
Hydraulic Power Tongs World Wide, Eckel Mfg. Co. Inc., 1993.
Strong, Tough Fast Hydraulic Power Tongs Best by Farr, Farr Int'l Co. Ltd. 1980.
Hillman–Kelley Power Tongs, Joy Mfg. Co., 1978.

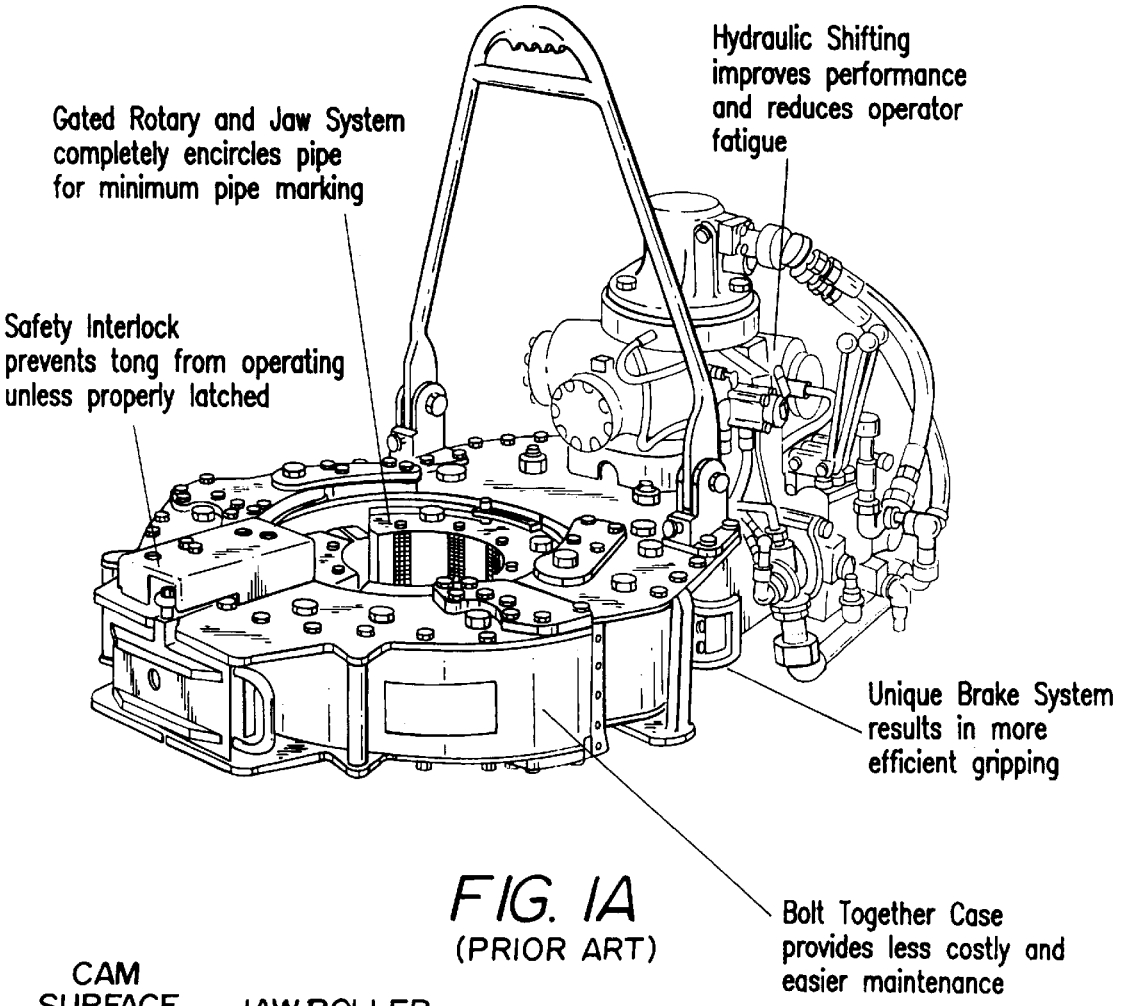
FIG. 1A
(PRIOR ART)
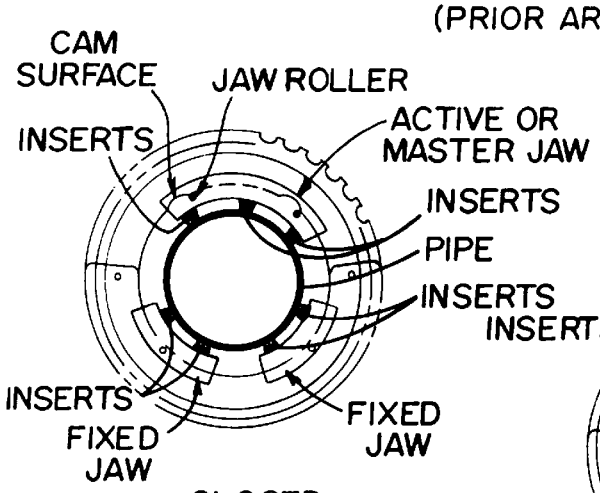
CLOSED
FIG. 1B
(PRIOR ART)
FIG. 1C
(PRIOR ART)
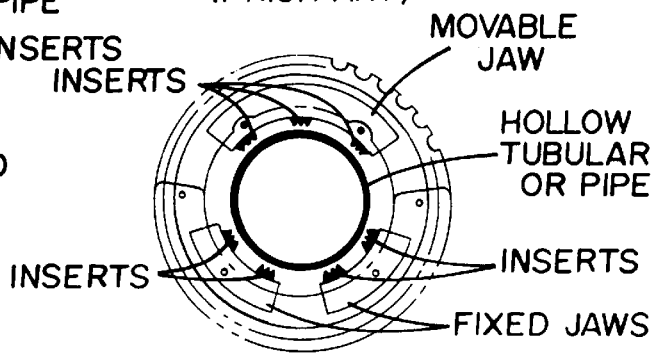
OPEN

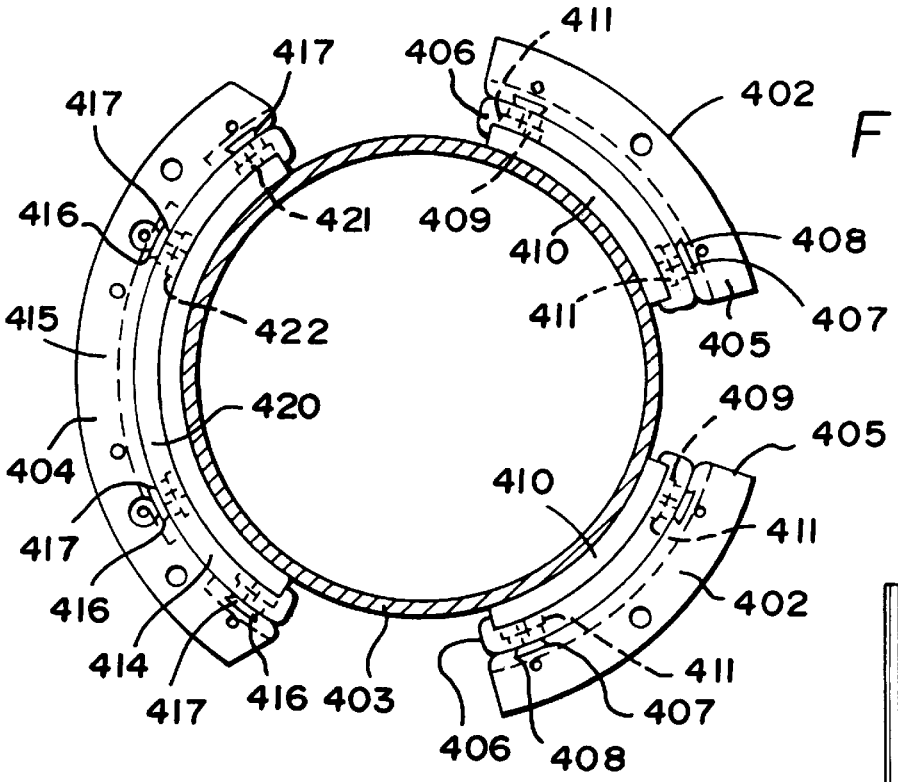
FIG. 4A
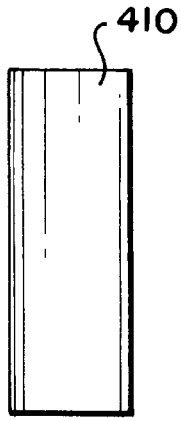
FIG. 4B
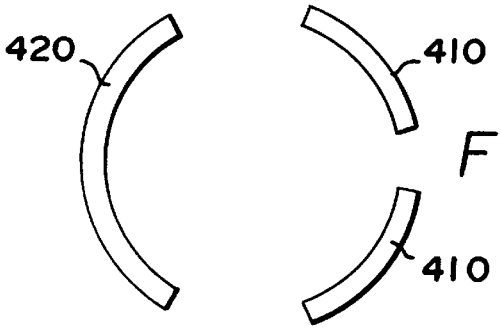
FIG. 4C
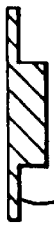
FIG. 4F
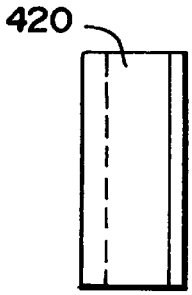
FIG. 4D
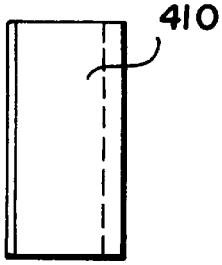
FIG. 4E
FIG. 4G
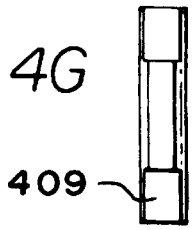

FIG. 6A
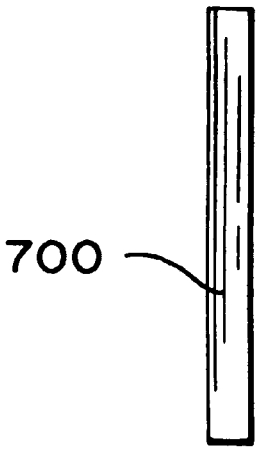
FIG. 7A
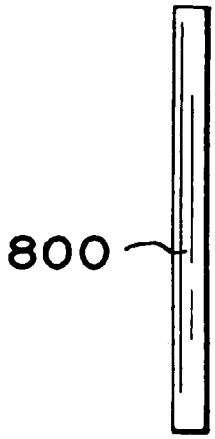
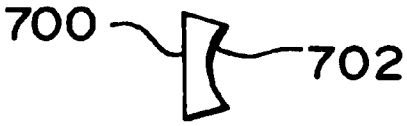
FIG. 6B
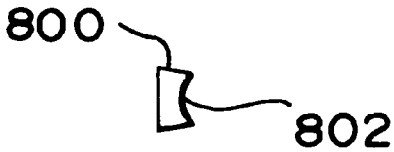
FIG. 7B

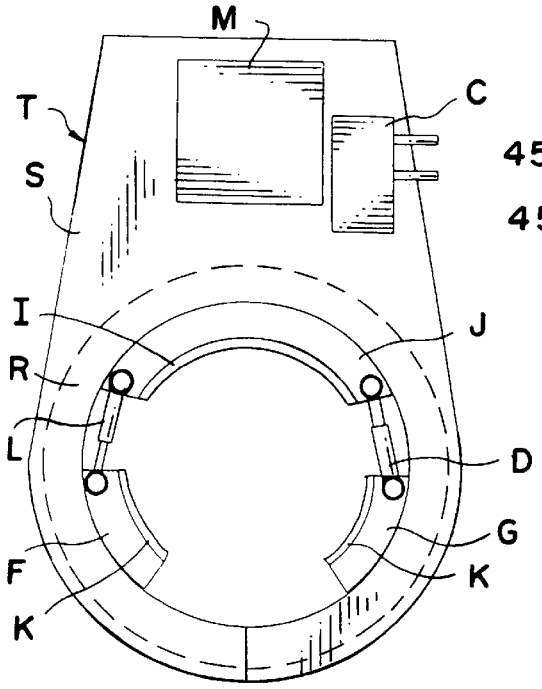
FIG. 8
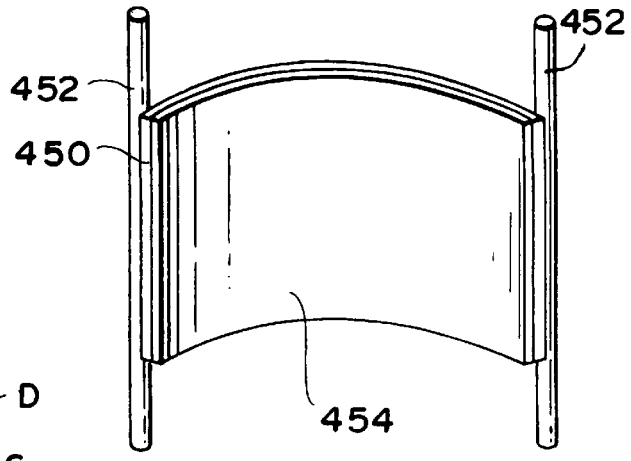
FIG. 9
FIG. 10
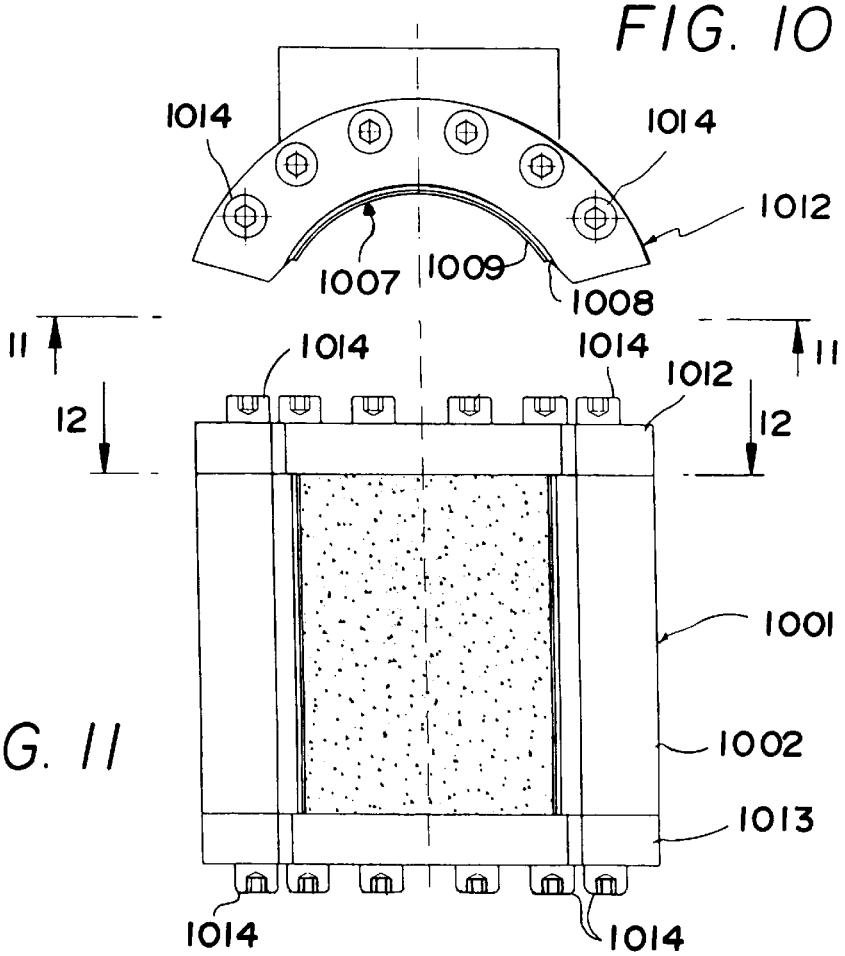
FIG. 11

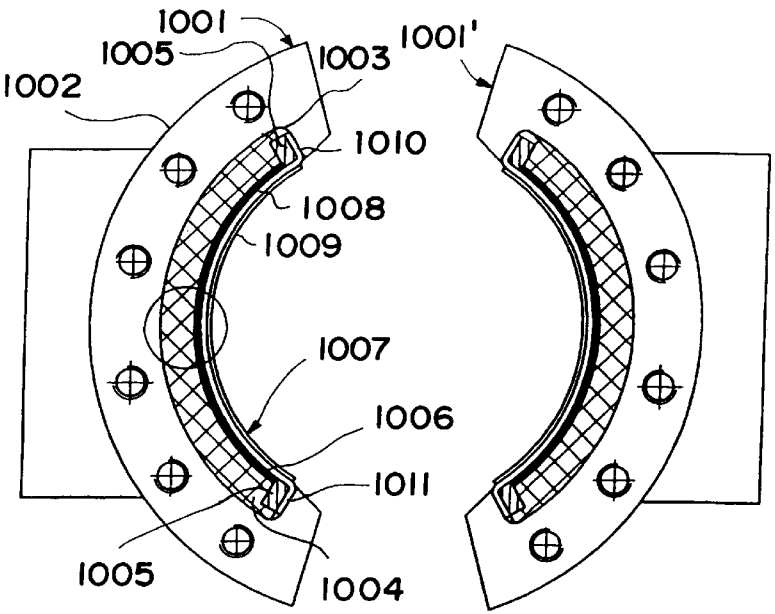
FIG. 12
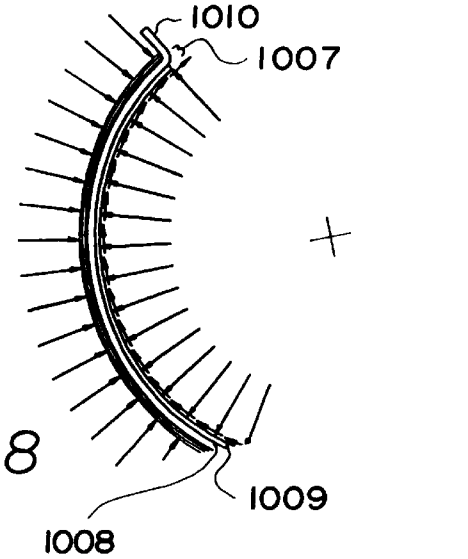
FIG. 18
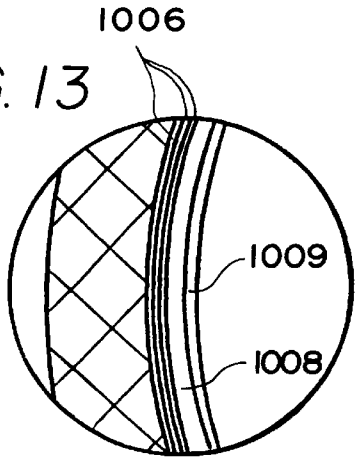
FIG. 13
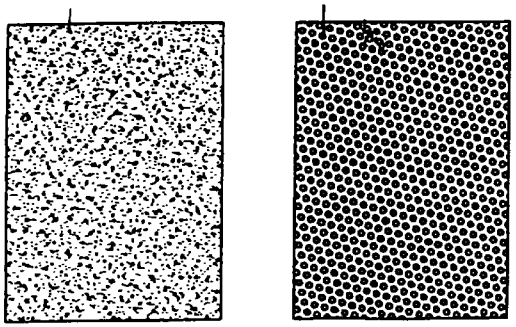
FIG. 14
FIG. 15
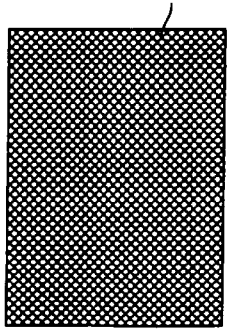
FIG. 16
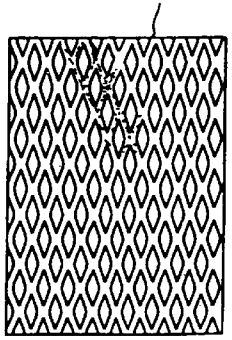
FIG. 17

FIG. 23
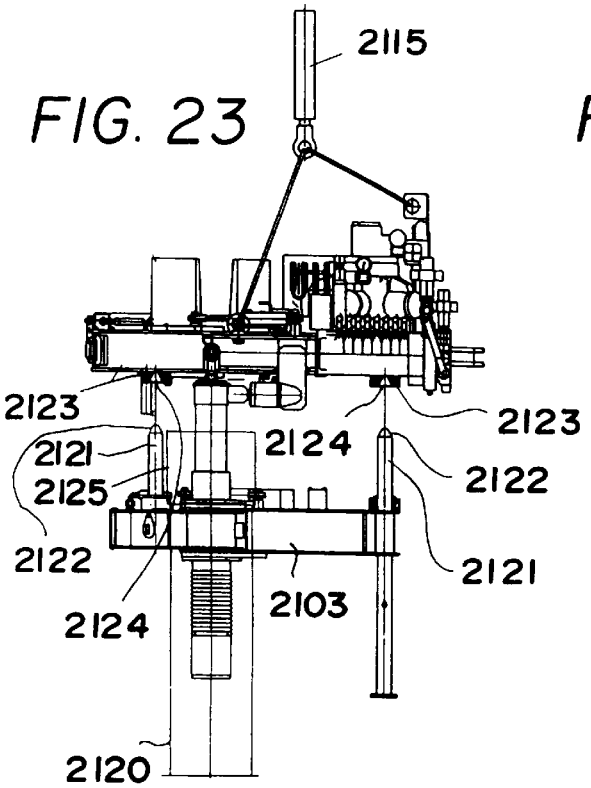
FIG. 24
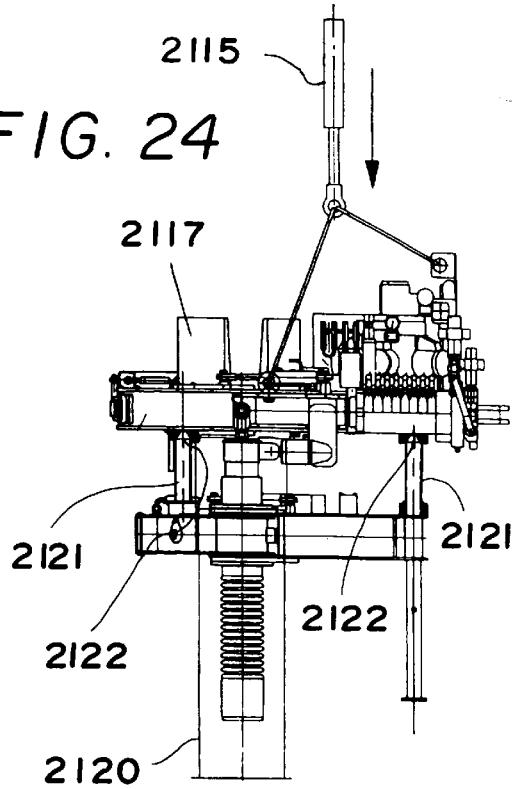
FIG. 25
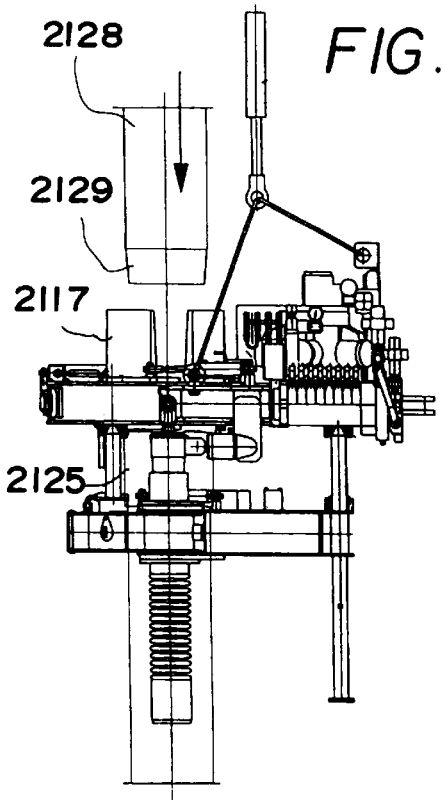
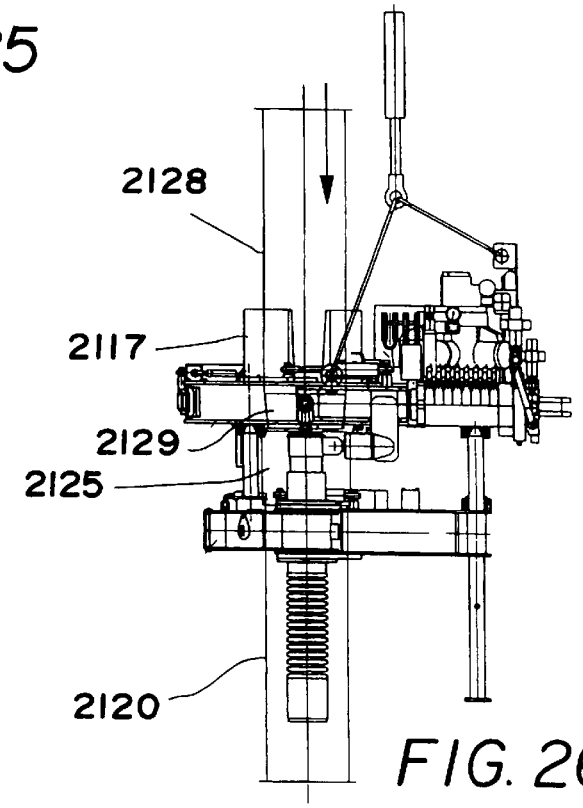
FIG. 26

FIG. 27
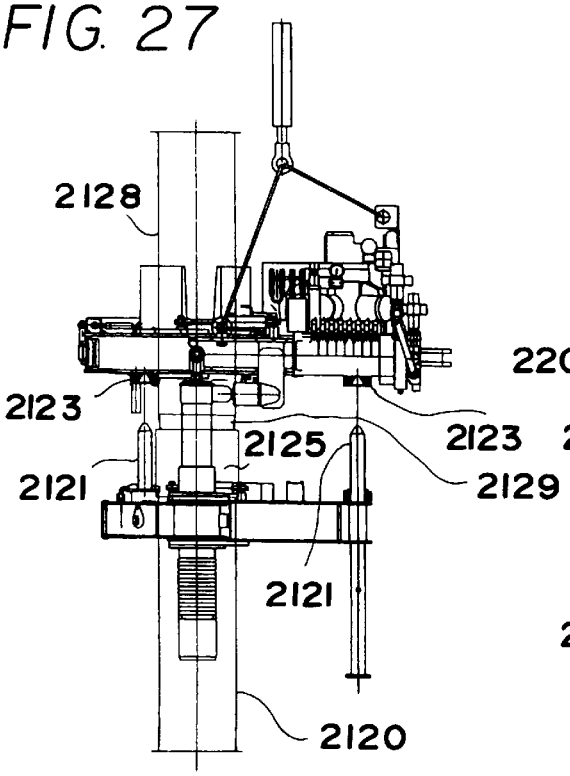
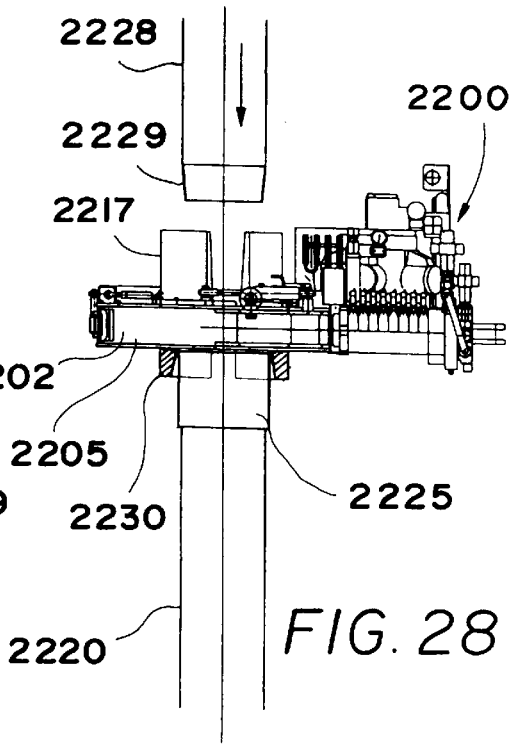
FIG. 28
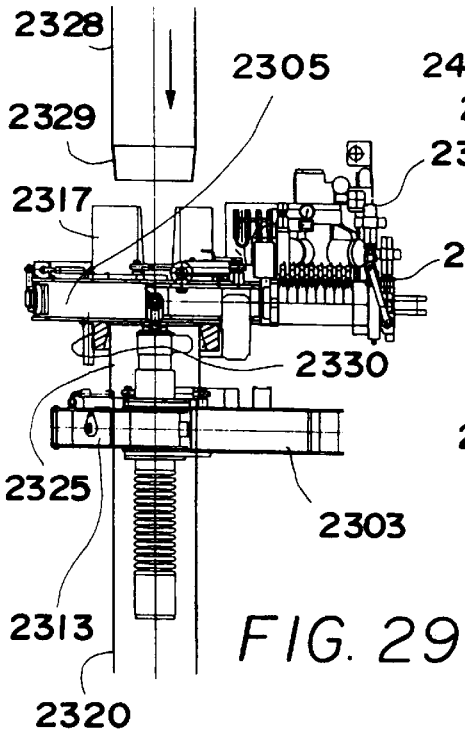
FIG. 29
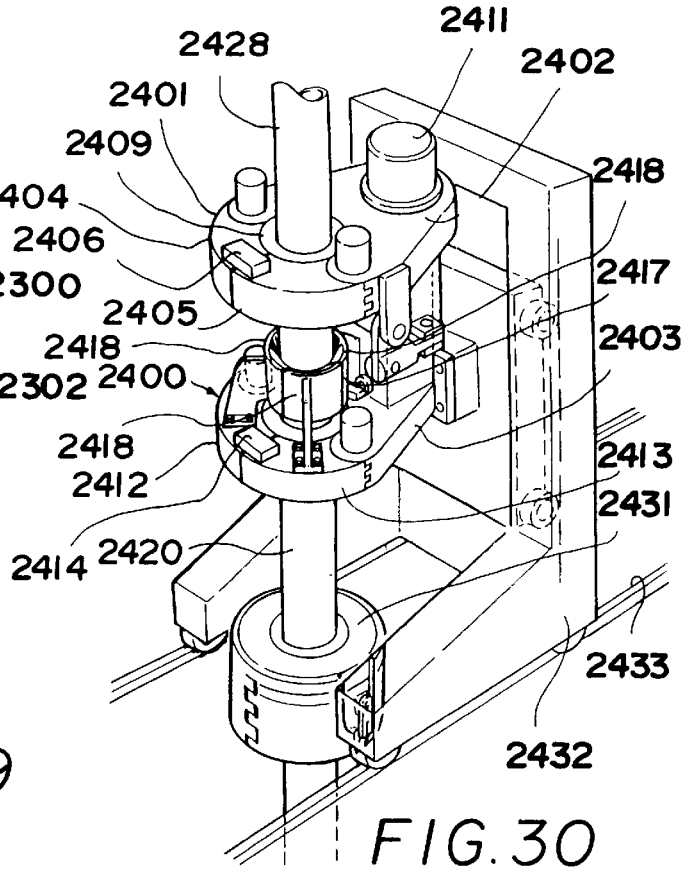
FIG. 30

POWER TONG

BACKGROUND OF THE INVENTION

1. Field of the Invention

This invention is directed to apparatus and methods for aligning wellbore tubulars; and to power tongs used in making and breaking joints of tubular members such as wellbore casing and tubing; to parts thereof; including, but not limited to gripping elements, and methods of their use.

2. Description of Related Art

During the drilling of oil and gas wells and the production of materials therefrom, various operations require the connection and disconnection of successive lengths of threaded tubulars such as pipe, casing, or tubing. Tools known as tongs are used to "make" and "break" such connections. Certain known power tongs have a body, a rotary rotatably mounted in said body and at least one active jaw which, on rotation of the rotary is cammed against a pipe in the rotary and grips it for rotation with the rotary. In known arrangements the camming action is generated by a cam member which is bolted to the rotary and is shaped so that the active jaw is cammed against the pipe on rotation of the rotary relative to the active jaw in one sense and will be released on rotation of the rotary relative to the active jaw in the opposite sense.

With known tongs high torques are applied to tubulars due to combinations of factors such as thread sealing requirements, the presence of corrosion, the existence of distortion, and pipe size and weight. Both in the "make" direction of rotation when a shoulder is suddenly encountered, and in the "break" direction at initial engagement of the tong and disengagement of the threads high shock forces may arise; e.g., with a power-driven tong, in excess of 50,000 foot-pounds of torque may be exerted, while relatively small die elements on jaws of the tong engage the pipe with extremely high force loadings. Slippage occurs and pipe surfaces become marred, marked, indented, or otherwise damaged.

Dies for gripping jaws have been provided with multiple serrations, or penetration features, to provide the interference contact at the joint surface. Grip element penetration into the joint surface is limited and controlled. The distribution and balance of grip element energizing forces are critical factors in the design, development and evaluation of such tong mechanisms. Linkages, levers, wedges, and cams are used to balance force components. Grip elements, or dies, are accurately disposed within carrier bodies, or jaws, which span a circumferential segment of the joint surface.

Uneven die loading can cause excessive indentation, marring or damage to a tubular surface. Drag or braking devices are used in certain tongs to effect proper biting of the dies relative to the pipe. The head or other member supporting the dies is frictionally restrained to insure that the dies do not simply rotate with the rotary as the rotary is driven.

Other tongs use an endless belt, chain or flexible material loop for gripping a tubular. Such tongs are disclosed in U.S. Pat. Nos. 3,799,010; 3,906,820; 3,892,140; 4,079,640; 4,099,479; and 4,212,212. There are a variety of problems associated with certain of these tongs:

- Endless chain is changed to accommodate tubulars of different size or apparatus is provided to maintain tubulars on a centered position for torque monitoring.
- Chain links can slip at high torques.
- Pivotable arms or gate members that fail to hold a tubular within the tong body allow the tubular to be thrown out from the tong.

- Relatively fragile tubulars can be collapsed by high loads.
- Slippage (which can cause galling and other damage to tubulars) occurs if the gripping element (belt, chain, etc.) loading mechanism does not maintain an adequate pre-load force on the tubular.

Jaw/die tongs and the belt/chain tongs are used with relatively hard and rigid metal tubulars such as casing and tubing. If these tongs are used with thick tubulars or tubulars made from relatively "softer" metals or from premium metals such as high alloy steels or low carbon steels or tubulars made from non-metal materials such as fiber glass, they often literally chew up the tubular. The use of strap wrenches is inadequate since the torque applied with such wrenches cannot be precisely controlled.

Certain tubulars are treated with a rust or corrosion resistant material or coating. If the coating is indented, gouged, or broken, its protective purpose is defeated. Producing enough force in a tong to join such tubulars while not injuring a protective coating presents a dilemma.

SUMMARY OF THE PRESENT INVENTION

The present invention, in certain embodiments, discloses a power tong for joining tubulars so that marking of, indentation of, and surface injury to tubulars are reduced or eliminated. In one aspect a power tong is provided and a method of its use for handling tubulars coated with a corrosion-resistant material which should not be broken or penetrated. In one embodiment such a tong has one or more gripping jaws with gripping elements made of aluminum alloys, zinc, zinc alloys, aluminum, brass, bronze, cermet, plastic, fiberglass, metal alloys, or a combination thereof which present a smooth face (straight or curved) to a tubular without any teeth, pointed projections, or toothed dies. In one aspect the gripping elements are releasably connected directly to jaws. In another aspect the gripping elements are releasably connected to a jacket or holder which itself is releasably connected to a jaw.

In certain aspects to achieve desired gripping forces, the gripping elements are relatively long longitudinally and the jaws are correspondingly enlarged or appropriate extension apparatus is connected thereto. With certain gripping elements the surface for contacting the tubular is flat; with other elements the surface is radiused to correspond to the curve of an outer tubular surface of a tubular to be rotated.

In order to effectively grip a tubular with gripping elements without teeth, points, or projections so that slippage is prevented, a larger normal force between the jaw and the tubular is needed to maintain gripping-element pipe contact. Pre-loading of jaws with one or more of these gripping elements is achieved, in certain embodiments of this invention, with a pre-load cylinder connected between a fixed gripping jaw and a movable gripping jaw. The cylinder applies a continuous pre-load force on the movable jaw which is not concentrated enough to injure the tubular but is large enough to develop sufficient friction to prevent slippage. In one aspect the force applied by the cylinder is controllable and is adjustable as desired. In one aspect two pre-load cylinders are used, each connected to a different fixed jaw and one at each end of a movable jaw, so that no cylinder movement is required to change modes, e.g. from make-up to breakout. In one aspect one cylinder is used which can be switched from one end of a movable jaw to the other to switch modes of operation.

In one aspect the cylinder(s) are powered by a small air-driven hydraulic pump with an hydraulic fluid reservoir mounted on a plate on the movable or fixed jaw. Air is supplied to activate a motor of the pump and the pump then provides hydraulic fluid to move a piston of the hydraulic cylinder(s). The motion of the cylinder moves the movable jaw on its roller to travel to a pre-load position on the cam. The cylinder applies pressure until the hydraulic pressure is released. A hydraulic fluid accumulator and a valve may be used to maintain hydraulic pressure at all times so that the cylinder(s) continuously maintain the desired load on the jaw until the air supply to the pump is removed.

In another aspect the cylinders are connected to a rotary of the tong or to any other member that rotates with the rotary rather than to a fixed jaw. Such a pre-load system may, according to this invention, be used with any tong including a tong that does use toothed dies.

In one embodiment the present invention discloses a gripping arrangement for a tong with a sheet of grit which is preferably bonded to a carrier plate. In another embodiment the gripping arrangement comprises a layer of flexible material having a smooth flat surface or a surface with ridges and valleys, for example in the fashion of the surface of a file. The flexible material, in one aspect, is metal, for example sheet aluminum, zinc, brass, bronze, zinc alloy, aluminum alloy, stainless steel, or steel having a thickness of about 1.5 mm. The layer of flexible material may be used in conjunction with a carrier plate or on its own. In a further embodiment the gripping arrangement may comprise a layer of perforate material one of both surfaces of which are preferably coated with grit to facilitate adhesion. The layer will typically be formed from metal having a thickness of about 1.5 mm. The layer may be used in conjunction with a carrier plate or used on its own. In yet another embodiment the gripping arrangement may comprise a layer of expanded mesh, e.g. metal mesh, which has been flattened. One or both surfaces of the expanded mesh may be coated with grit and the layer may be used in conjunction with a carrier plate or used on its own. The grit may comprise, for example, diamond dust, particles of silicon, zircon, tungsten carbide and mixtures thereof. The gripping arrangement may comprise end plates which are attached to the carrier plate. Preferably, the carrier plate is provided with side flanges for insertion into a jaw holder. The present invention also provides a jaw assembly fitted with a gripping arrangement in accordance with the present invention. Preferably, the jaw assembly includes a jaw holder having an arcuate recess which accommodates an arcuate pad of resilient elastomeric material which supports said gripping arrangement. Advantageously, at least one shim is provided which is disposed between said arcuate pad of resilient elastomeric material and said gripping arrangement. The shim will be flexible and generally from 0.5 mm to 1.0 mm thick and made from sheet metal. The present invention also provides a tong fitted with at least two such jaw.

In one embodiment the present invention discloses an apparatus for aligning tubulars and includes a guide on one of a power tong and a backup tong. In one embodiment the apparatus has a socket centralizer mounted on said one of said power tong and said backup tong. In one aspect, said one of said power tong and said backup tong is said power tong. In another embodiment, the apparatus includes a power tong and a backup tong, and the guide is mounted on the power tong and apparatus is provided to maintain the power tong and the backup tong in a certain juxtaposition during a stabbing operation. Preferably, said apparatus includes locating rods on one of the power tong and the backup tong and blocks shaped to receive at least the ends of the locating rods on the other of the power tong and the backup tong. Advantageously, the backup tong is provided with at least two prismatic jaw assemblies to locate the backup tong in fixed juxtaposition with respect to a tubular being gripped.

The present invention, in one aspect, provides a jaw unit for use in a tong, which jaw unit comprises a jaw holder and a jaw movable with respect to said jaw holder, characterized in that said jaw is slidably mounted on said jaw holder. Preferably, said jaw is slidable with respect to said jaw holder about an arcuate path. Advantageously, said jaw has a gripping surface which is substantially arcuate for gripping the surface of a tubular and the center of curvature of such arcuate path lies between the center of curvature of said grip ping surface and said arcuate path. The gripping surface may be a continuous surface or defined by several spaced apart gripping elements. Preferably, the center of curvature of said arcuate path lies between the center of curvature of said grip ping surface and said gripping surface. Advantageously, the center of curvature of said arcuate path is substantially midway between the center of curvature of said gripping surface and said gripping surface. Preferably, one of said jaw and said jaw holder is provided with an arcuate track which defines said arcuate path, and the other of said jaw and said jaw holder is slidably mounted in said arcuate track.

The present invention also provides a jaw assembly comprising two jaw units in accordance with the present invention. Preferably, said jaw units are mounted for pivotal movement about a common pivot shaft. Advantageously, said jaw assembly includes means which bias said jaw units apart. The present invention also provides a rotary fitted with a jaw unit in accordance with the present invention, a rotary fitted with a jaw assembly in accordance with the present invention, and a tong fitted with a rotary in accordance with the present invention.

Traditionally, a rotary is made from three separate pieces, i.e. a top section, a bottom section and a peripheral wall. Each section has to be carefully made and machined to ensure that all three sections can be bolted together. This involves considerable skilled work and consequently a rotary is a relatively expensive item. In order to help overcome this the present invention provides a rotary formed as a one piece casting.

One of the features of existing tongs is that their rotaries are difficult to furnish. Thus, routine maintenance usually involves dismantling the whole rotary, checking the parts and reassembling the whole. While this is a straightforward procedure in the clean conditions of a workshop it can be problematic when carried out in a muddy field, in sand or in snow. The present invention aims to help solve this problem and provides a rotary which comprises a top section, a bottom section, and a peripheral wall therebetween, characterized in that at least one of said top section and said bottom section is provided with an elongate slot which, when said rotary is in use, accommodates a pivot shaft on which a jaw assembly can be pivotally mounted.

Jaw holders and jaws for tongs are traditionally machined from a solid piece. This is a comparatively expensive procedure. The present invention proposes to make such parts from a stack of individually cut laminations.

In one aspect, the laminations are cut with a laser from sheet steel. The stack of laminations is then, for many purposes, welded together along their sides and/or bolted together and/or glued together. Mass produced laminations are relatively inexpensive and an acceptable final product is produced at a fraction of the cost of a product machined from the whole.

It is, therefore, an object of at least certain preferred embodiments of the present invention to provide:

New, useful, unique, efficient, nonobvious devices, parts thereof, and methods for rotating tubular members in wellbore operations;

Such methods and devices including a power tong with at least one jaw with at least one tubular gripping element having a smooth gripping surface (flat or curved) and, in one aspect, such an element which is flexible;

Such gripping elements with grit or mesh thereon;

Such methods and devices including apparatus to apply a pre-load to a gripping element carrier or jaw so the gripping element will adequately grip the tubular without slipping on it or damaging it; and Such methods and devices wherein a single pre-load apparatus is movable to provide a pre-load on multiple jaws or gripping elements; or each such jaw or gripping element has its own pre-load apparatus;

New, useful, unique, efficient, nonobvious devices and methods for aligning tubulars in wellbore operations.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 1A shows a prior art power tong. FIGS. 1B and 1C show the jaw system of the tong of FIG. 1A.

FIG. 3C is a view along line 3C—3C of FIG. 3A. FIG. 3D is a view along line 3D—3D of FIG. 3A FIGS. 4A–4G show an alternative jaw system for a tubular connection system according to the present invention. FIG. 4A is a top view of the jaw system. FIG. 4B is a side view of one of the inserts of the system of FIG. 4A. FIG. 4C is a top view of jaw inserts of the system of FIG. 4A. FIG. 4D is a side view of one of the inserts of FIG. 4C. FIG. 4E is a side view of one of the inserts of FIG. 4A. FIG. 4F is a side view of a key of the system of FIG. 4A. FIG. 4G is a front view of the key of FIG. 4C.

FIG. 6A is a side view of a jaw insert according to the present invention. FIG. 6B is a top view of the insert of FIG. 6A.

FIG. 7A is a side view of a jaw insert according to the present invention. FIG. 7B is a top view of the insert of FIG. 7A.

FIG. 8 shows schematically a top view of a power tong according to the present invention.

FIG. 9 is a perspective view of a jaw with an insert according to the present invention.

FIG. 10 is a top plan view of one embodiment of a jaw assembly in accordance with the present invention.

FIG. 11 is a side elevation of the jaw assembly taken on line 11—11 of FIG. 10.

FIG. 12 is a view taken on line 12—12 of FIG. 11 and showing a second jaw assembly.

FIG. 13 shows, to an enlarged scale, the detail encircled in FIG. 12.

FIG. 14 is a front elevation of a first embodiment of a flexible gripping member in accordance with the present invention and which is used in the jaw assembly shown in FIGS. 10 to 13.

FIGS. 15, 16 and 17 show front elevations of alternative flexible gripping members.

FIG. 18 shows diagrammatically how the forces are transmitted through the flexible gripping member in use.

FIG. 23 is a side elevation of the apparatus shown in FIGS. 20*a* and 20*b* in a first position;

FIG. 24 is a side elevation of the apparatus shown in FIGS. 20A and 20B in a second position.

FIG. 25 is a side elevation of the apparatus shown in FIGS. 20A and 20B in a third position.

FIG. 26 is a side elevation of the apparatus shown in FIGS. 20A and 20B in a fourth position.

FIG. 27 is a side elevation of the apparatus shown in FIGS. 20A and 20B in a fifth position.

FIG. 28 is a side elevation of another embodiment of an apparatus in accordance with the present invention.

FIG. 29 is a side elevation of another embodiment of an apparatus in accordance with the present invention.

FIG. 30 is a perspective view of another embodiment of an apparatus in accordance with the present invention.

DESCRIPTION OF EMBODIMENTS PREFERRED AT THE TIME OF FILING FOR THIS PATENT

FIGS. 1A–1C show a typical prior art power tong that uses fixed jaws and a movable jaw to grip pipe for tubular disconnecting and connecting operations. An outer case houses a powered rotary to which the jaws are mounted. A cam surface of the rotary moves a movable (ACTIVE or MASTER) jaw into (and away from) gripping contact with a tubular, e.g. pipe. Each jaw has toothed gripping inserts to facilitate engagement with the surface of the tubular (see FIG. 1B). FIG. 1C shows the tong in an "OPEN" position in which the tubular is not gripped.

The tong shown in FIG. 1A is a Weatherford Model 14.5-50 High Torque Tong. The brochure "New ! Weatherford Model 14.5-50 High Torque Tong," (1991) and the manual entitled "Model 14.5-50 Hydraulic Power Tong Installation, Operation and Maintenance" (1993) are submitted herewith and incorporated herein fully by reference for all purposes. It is to be understood that the teachings of the present invention are applicable to any tong and any tong system that has one or more gripping elements or jaws and that the Model 14.5-50 tong is shown here for illustrative purposes and not by way of limitation of the scope of the present invention.

Figure 2C:
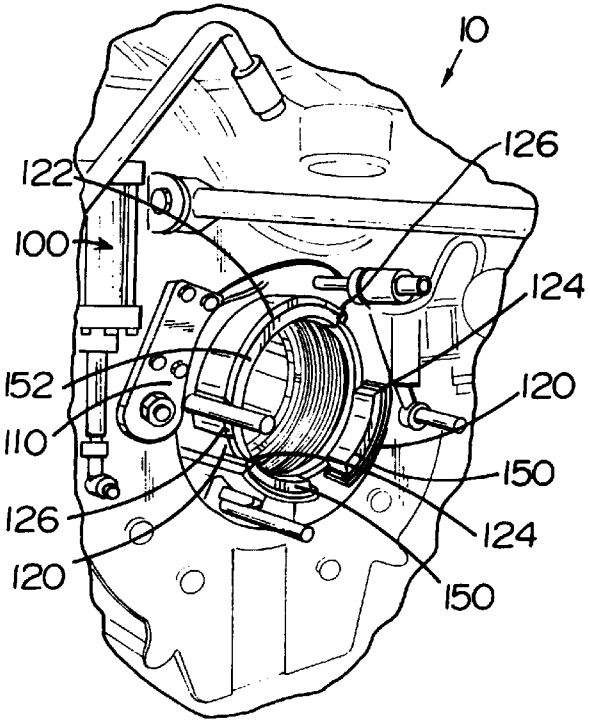
FIGS. 2B and 2C are perspective views of a casing tong of the system of FIG. 2A.
Figure 2B:
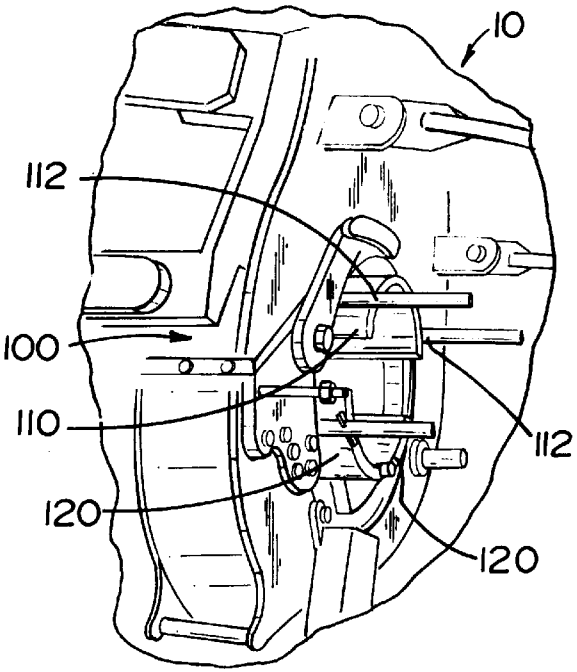
Figure 2A:
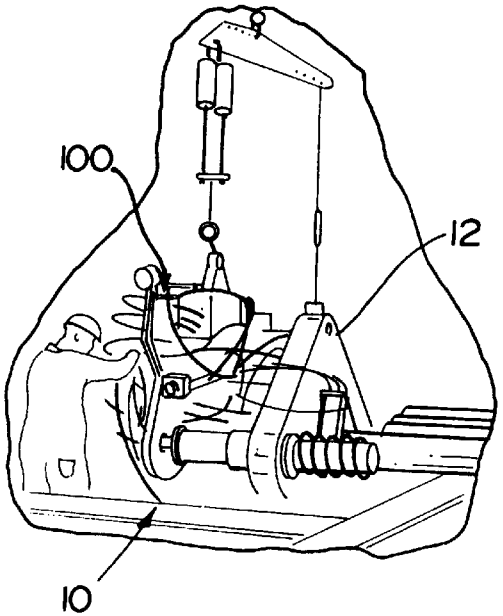
FIG. 2A is a perspective view of a tubular connection system according to the present invention.
Figure 5A:
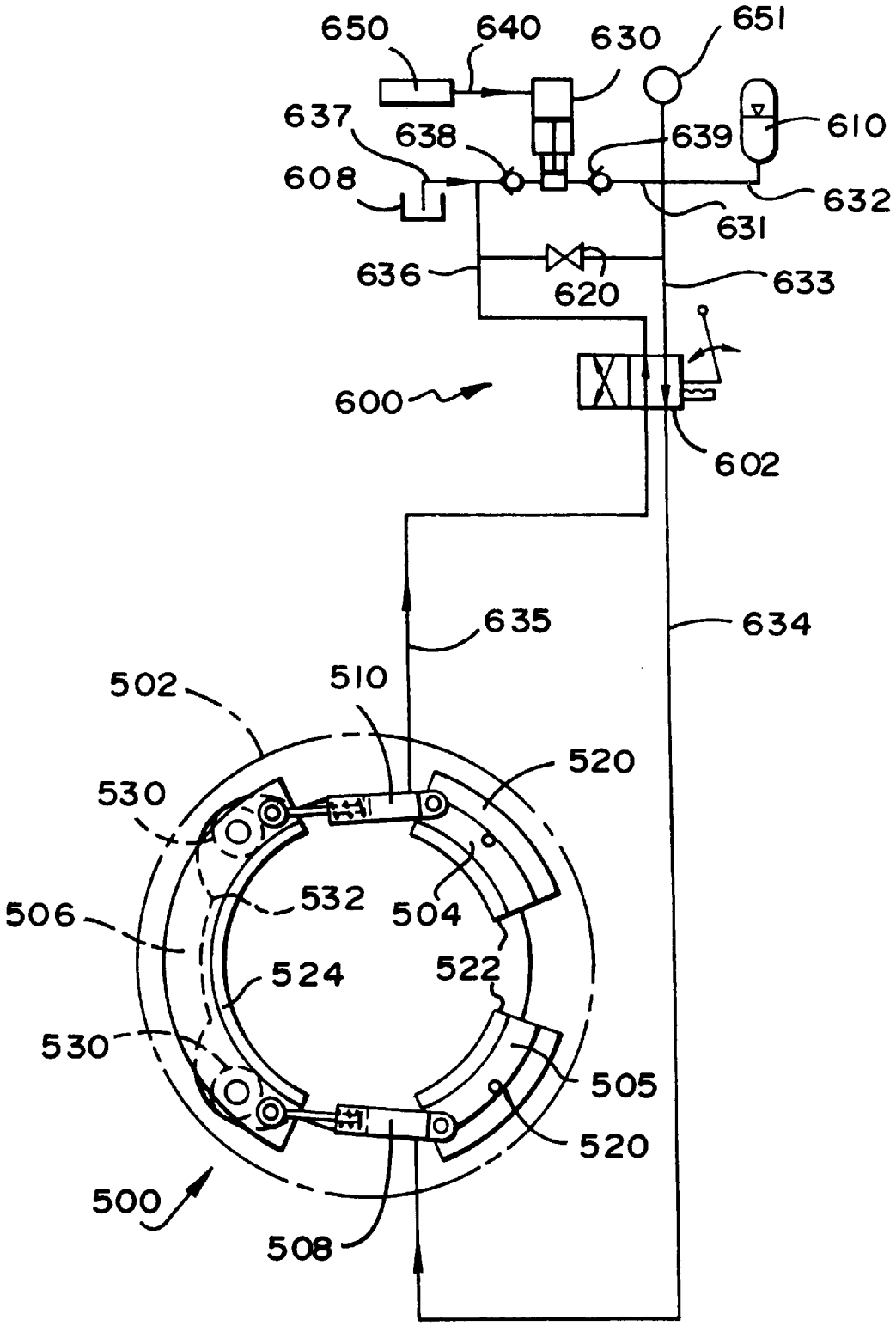
FIG. 5A shows schematically an initial position of elements of a tong system according to the present invention.

As shown in FIG. 2A a system 10 according to the present invention includes a power tong 100 according to the present invention which is like the tong of FIG. 1A but which also includes a unique jaw system 110 with inserts 150 on fixed jaws 120 and insert 152 on movable jaw 122 and at least one jaw pre-load assembly like that shown in FIG. 5A. The system 10 includes a free floating backup tong 12.

As shown in FIGS. 2B and 2C, rods 112 are connected to the movable jaw 122. The inserts 150 are on fixed jaws 120 and the insert 152 is on a movable jaw 122 (corresponding to the fixed jaws and active jaw, respectively, of the tong of FIG. 1A).

Figure 3A:
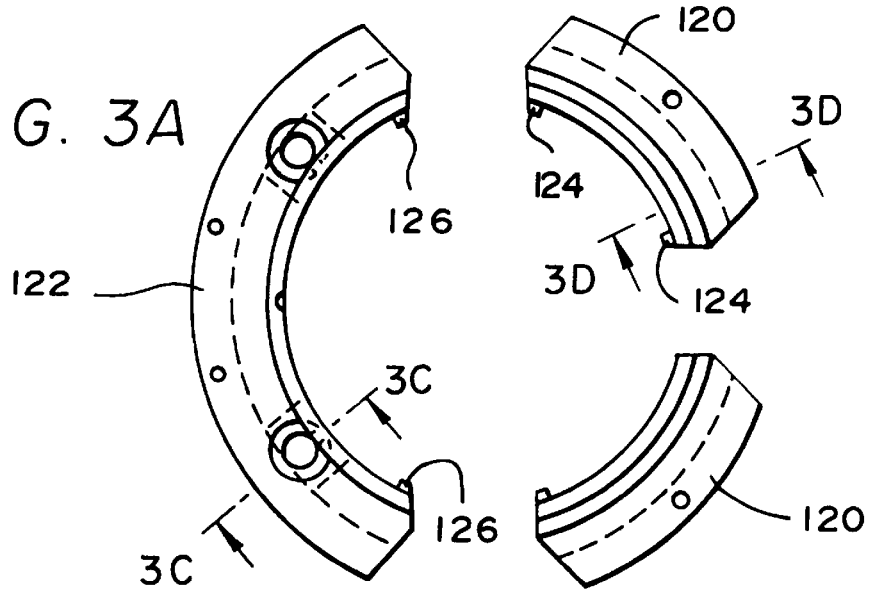
FIGS. 3A–3D show a jaw system of the tubular connection system of FIG. 2A.
Figure 3B:
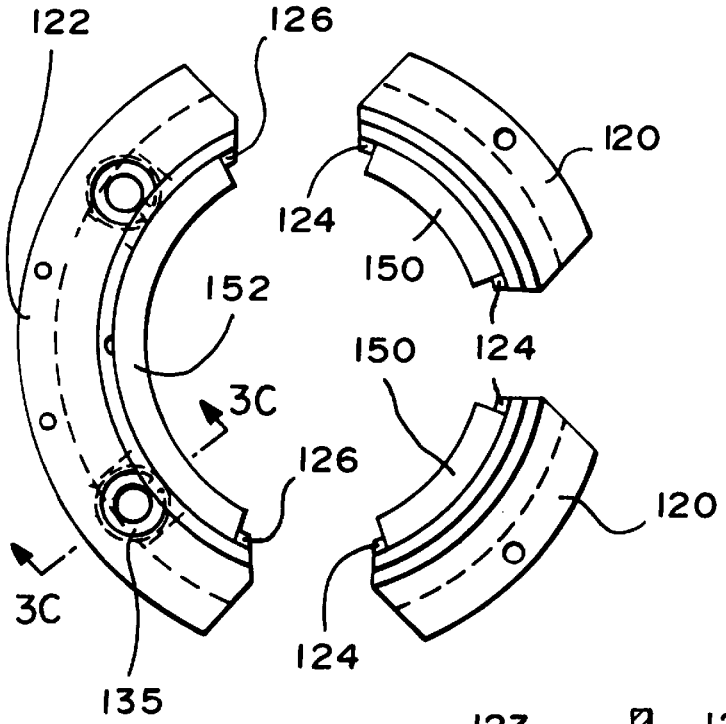
Figure 3D:
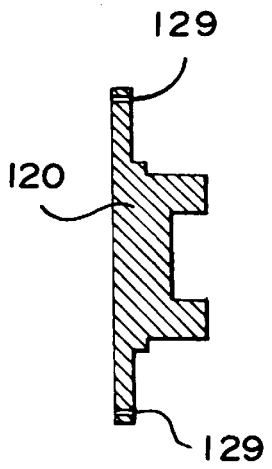
Figure 3C:
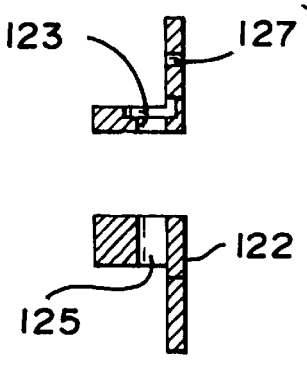

Stops 124 hold jaws 120 and prevent sideways insert movement. The stops 124 may be welded to the jaw or otherwise secured. Removable bolts may be used instead of the stops 124. The stops 126 perform the same functions. A right angled member 127 (FIG. 3C) maintains a roller 135 rotatably in place in holes 123, 125. Holes 129 either receive a projection of an insert to maintain the insert in place or a pin extends through the hole 129 into the insert to accomplish this.

FIGS. 4A–4G illustrate an alternative jaw mounting system in which holders are interposed between jaw bodies and inserts. The holders protect the jaws from damage if the inserts wear down and a variety of different types and/or sizes of inserts may be used with and interchanged on a single holder. In one aspect it is within the scope of this invention to use these holders to mount conventional toothed dies to a tong jaw and to use them for easy substitution of new and/or different dies.

FIG. 4A shows a jaw system 400 for a tong (like the tong of FIG. 2A) which has two fixed jaws 402 and a movable (movable toward and away from a tubular to be gripped 403) jaw 404. Each jaw 402 has a jaw body 405 with a holder 406 secured thereto. In one aspect dovetail keys 407 secured to the holder or releasably mounted thereto fit in corresponding slots 408 of the jaw bodies 405 to releasably mount the holder 406 to the body. In one aspect dovetail keys 409 releasably mount the holders 406 to jaw bodies 405. The dovetail keys 409 are releasably held in corresponding recesses 411 in the holders 406. One or more dovetail keys 409 may be used (two shown for each holder 406).

Similarly a holder 414 is mounted to a jaw body 415 of the jaw 404 and dovetail members 416 are received and held in corresponding slots 417.

An insert 420 has dovetail keys 421 received and held in corresponding slots 422 of the holder 414. The insert 420 is shown as a single unitary insert but a plurality of individual inserts (either abutting or spaced apart) may be used secured to the jaw body 415.

It is preferred that the insert 420 extend for an arc of at least 40 degrees and most preferably at least about 90 degrees. It is preferred that each insert 410 extend for an arc of at least 20 degrees and most preferably at least about 60 degrees. In another aspect it is preferred that the combined arcs of the three inserts in FIG. 4A extend for at least 180° of the total 360 degree circumference of the tubular 403 and most preferably for at least 20 degrees.

FIG. 4D shows the insert 420.

FIG. 4E shows the insert 410.

FIGS. 4F and 4G shows a key 409.

FIG. 5A shows a tong system 500 with a tong having a movable rotary 502, fixed jaws 504, 505, and a movable jaw 506 (remainder of tong, not shown, like the tong of FIG. 2A; like the tong of FIG. 1A, but with the added features discussed here). Pins 520 pin the fixed jaws to the rotary. Inserts 522 on the fixed jaws 504, 505 are like the inserts described herein for other fixed jaws. Insert 524 on the movable jaw 506 is like other inserts described herein for movable jaws. A pre-load cylinder 508 to assist in make-up is pivotably connected at one end to the fixed jaw 505 and at the other end to the movable jaw 506. A pre-load cylinder 510 to assist in break-out is pivotably connected at one end to the fixed jaw 504 and at the other end to the movable jaw 506. It is within the scope of this invention for the ends of cylinders connected to the fixed jaws to instead be secured to the rotary or to a support ring or other member that rotates with the rotary. It is within the scope of this invention to employ one cylinder interchangeable between the positions of the cylinders 508 and 510 (FIG. 5A) or one cylinder connectible to the fixed jaw 506 at one end for break-out and at the other end of the fixed jaw 506 for make-up with the other cylinder end secured to the rotary. Rollers 530 rotatably mounted on the movable jaw 506 co-act with cam surfaces 532 on the rotary 502 to move the jaw 506 to operative and inoperative positions.

A control system 600 directs fluid for actuating the pre-load cylinders to and from the cylinders. In a system with one cylinder a simpler control system is used which applies fluid to the cylinder as needed and extracts it therefrom as desired.

The system 600 has a directional control valve 602 that directs fluid from a reservoir 608 in lines 604, 606 to one or both cylinders or from one or both cylinders. An accumulator 610 holds sufficient hydraulic fluid under pressure to maintain desired continuous pressure levels on the pre-load cylinders so that the cylinders maintain the desired pre-load force without interruption or decay due to fluid bleed-off.

A bleed valve 620 functions to selectively release pressure from the pre-load cylinders following make-up or break-out. A pump 630 pumps hydraulic fluid from the reservoir 608 to a line 631, in a line 632 to the accumulator 610, in a line 633 to the directional control valve 602, and in lines 634 and 635 to (and from) the pre-load cylinders 508 and 510. A check valve 638 in a line 637 from the reservoir 608 prevents fluid from flowing back into the reservoir. A check valve 639 in the line 631 insures that the pump 630 pumps fluid only from the reservoir and prevents fluid from the cylinder 508, 510 and/or from the accumulator 610 from flowing back to the pump 630 and to the reservoir 608.

Air in a line 640 selectively applied with a control system 650 (e.g. mounted on the rig floor, on the tong or remote controlled) selectively actuates the pump 630 to pump fluid through the valve 602 to the pre-load cylinders. The directional control valve 602 is either manually operated or operated by remote control. Correct fluid pressure is monitored with a gauge 651.

Figure 5B:
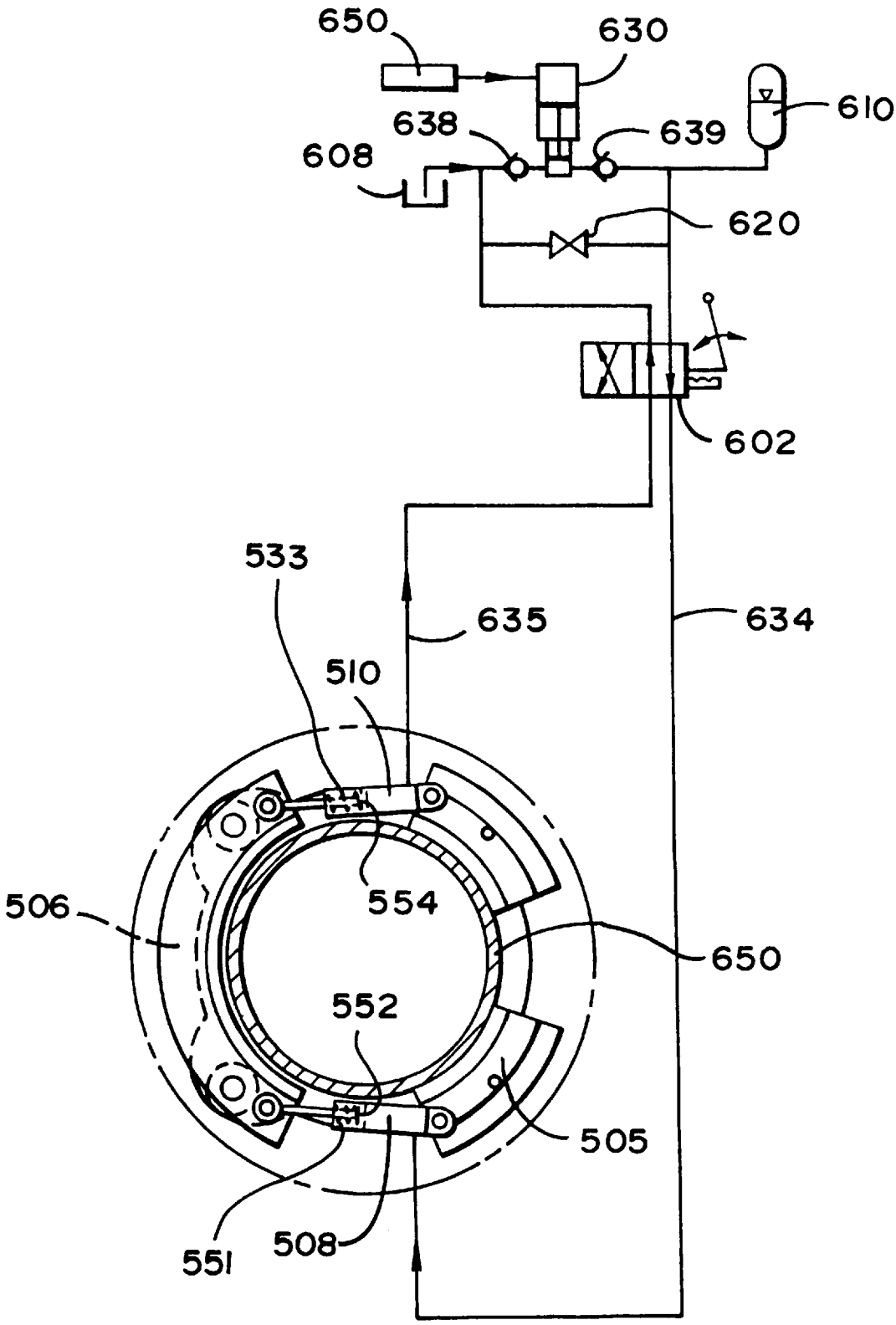
FIG. 5B shows pre-loading on a pipe of the jaws of the system of FIG. 5A.

As shown in FIG. 5B, the system 500 is being pre-loaded for gripping a tubular 650. Fluid is applied into the pre-load cylinder 508 to overcome a spring force of a spring 551 and allow a piston 552 to move the movable jaw 506 away from the fixed jaw 505. The directional control valve 602 is set to permit fluid to be pumped in the line 634 to the pre-load cylinder 508.

Simultaneously fluid is flowing out in line 635 from the pre-load cylinder 510, allowing its spring 553 to urge its corresponding piston 554 inward into the pre-load cylinder 510 thereby pulling the end of the movable jaw toward the fixed jaw 504 and increase the loading of the jaw 506 on the tubular 650.

Figure 5C:
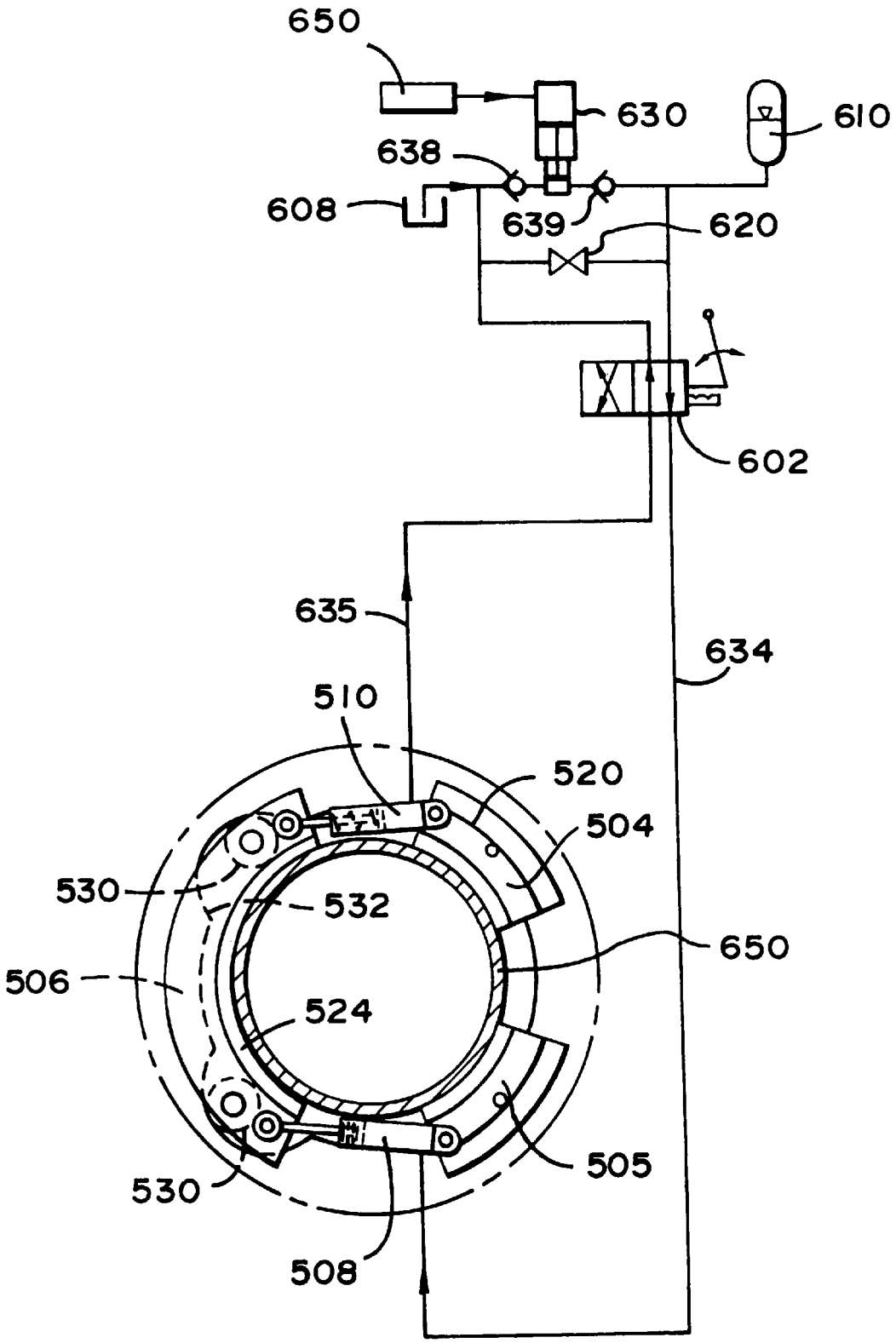
FIG. 5C shows a tubular gripped with the system of FIG. 5A.

As shown in FIG. 5C the tubular 650 has been gripped due to the action of the pre-load cylinder 510 with a suitable pre-load force (e.g., but not limited to, about 500, 1000, 5000, 10000 or 50000 pounds of force). This force is sufficient that when the rotary 502 of the tong is rotated the jaws do not slip on the tubular 650; but the pre-load force is sufficiently low that the jaws do not mark or damage the tubular 650.

FIG. 6A shows an insert 700 according to the present invention which is made of aluminum. It is within the scope of this invention for the inserts disclosed herein to be made any suitable material of suitable hardness, including, but not limited to, zinc, copper, brass, bronze, soft steels, or any suitable bearing material or metal alloy of aluminum, zinc, or other suitable metals. Optional teeth or projections at any desired angle may be provided on a curved surface 702 or it may be smooth. The surface 702 may be curved to corresponding to the curved outer surface of a tubular. Alternatively the surface 702 may be straight and flat.

FIG. 7A shows an insert 800 according to the present invention which is made of aluminum. It is within the scope of this invention for the inserts disclosed herein to be made any suitable material of suitable hardness, including, but not limited to, zinc, copper, brass, bronze, soft steels, or any suitable bearing material or metal alloy of aluminum, zinc, or other suitable metals. Optional teeth or projections at any desired angle may be provided on a curved surface 802 or it may be smooth. The surface 802 may be curved to corresponding to the curved outer surface of a tubular. Alternatively the surface 802 may be straight and flat.

FIG. 8 shows schematically a top view of a power tong according to the present invention. A power tong T has an hydraulic motor M with control/monitor apparatus C on a tong case S. A movable jaw J is moved and rotated by a rotary R which is moved by interconnection, via appropriate gearing, by the motor M. Fixed jaws F and G are secured to the rotary R. A first pre-load cylinder D connects the movable jaw J to the fixed jaw G for applying a pre-load to the movable jaw for make-up operations. A second pre-load cylinder L connects the movable jaw J to the fixed jaw F for applying a pre-load to the movable jaw for break-out operations. An insert I (any insert disclosed herein) is secured to the movable jaw J and inserts K (any insert disclosed herein) are secured to the fixed jaws F and G.

FIG. 9 shows a tong jaw 450 according to the present invention with an insert 454 (any insert disclosed herein) and rods 452 secured thereto, e.g. by welding. The rods 452 provide a member to which either a cylinder body or a piston of a pre-load piston cylinder apparatus is connectible. Instead of the rods 452 as shown which extend from above the jaw 450 to a point below it, only rod sections may be used secured to one or both sides of the jaw to provide a securement member for an end of a pre-load apparatus.

According to the present invention a variety of apparatuses and devices may be employed to pre-load a tong jaw having one or more smooth faced gripping insert elements thereon. In one aspect a manually activated pre-load cylinder is used which has fluid or material manually introduced therein to apply a pre-load or manually removed therefrom to release a pre-load. In another aspect a pre-load cylinder is pivotably secured at one end to a rotary or part thereof and the other end is releasably connectible to either end of a movable jaw so that a pre-load may be applied, selectively, to either end of the movable jaw for make-up or break-out operations as desired. In one aspect such a pre-load cylinder has a rod with an end member receivable in and movable in a slot in the movable jaw or there are recesses at either end of the jaw for holding the end member of the rod so that a pre-load can be applied. A secondary small cylinder may be used to selectively move the pre-load cylinder in the jaw slot or it can be moved manually. In another embodiment the tong's movable jaw has one or more upwardly projecting lugs engageable by a forked piston rod end of a pre-load piston/cylinder that is attached to the rotary. The rotary is rotated so that the jaw is cammed into the pipe to be rotated in a pre-load position and then the forked rod is removed for further tong operations.

Referring to FIGS. 10 to 14 of the drawings there is shown a jaw assembly which is generally identified by the reference numeral 1001.

The jaw assembly 1001 comprises a jaw holder 1002 which is provided with an arcuate recess 1003 which accommodates an arcuate pad 1004 of resilient elastomeric material. A block 1005 of steel is molded into each end of the arcuate pad 1004 as shown. Three thin shims 1006 of metal each having a thickness of about 0.5 mm are positioned on the inner surface of the arcuate pad 1004 and support an insert or gripping arrangement 1007 which comprises a carrier plate 1008 and a friction layer 1009. The carrier plate 1008 has side flanges 1010 and 1011 which clip over the blocks 1005 as shown. The top and bottom of the carrier plate 1008 are tack welded to end plates 1012 and 1013 which are bolted to the jaw holder 1002 by socket screws 1014. The friction layer 1009 comprises a sheet of zircon paper which is bonded to the carrier plate 1008. The carrier plate 1008 is made of sheet steel and is approximately 1.5 mm thick. As such it is quite flexible.

In use, two or more jaw assemblies are placed in a tong and are disposed around a length of casing. The jaw assemblies 1001, 1001' are then advanced radially inwardly in the direction of arrows "A" (FIG. 12) until they engage and firmly grip the casing. Because of the flexible construction of the gripping arrangement 1007, the shims 1006 and the arcuate pad 1004, the friction layer 1009 substantially conforms to the circumference of the casing and grips the casing with a substantially uniform gripping action. Once the casing has been firmly gripped the jaws are rotated by the tong in the usual manner. It will be noted that circumferential forces applied to the friction layer are transmitted through the carrier plate 1008 so that any local loads caused, for example by an irregularity in the surface of the casing are redistributed by the carrier plate 1008 and transmitted to the jaw holder 1002 via the side flange 1011 and the arcuate pad 1004 (see FIG. 18).

Various modifications to the embodiment described are envisaged, for example the friction layer 1009 could comprise silica paper, carborundum paper, tungsten carbide paper, or diamond paper, the term "paper" as used herein including cloth. If desired the friction layer 1009 may comprise a layer of flexible material, for example metal, having a surface formed with ridges and valleys similar to the surface of a metal file. Such an arrangement is shown in FIG. 15 where the friction layer has been identified by reference numeral 1009'. In this embodiment the friction layer could be bonded to the carrier plate. However, it is conceivable that the carrier plate could be dispensed with since the friction layer 1009' is capable of redistributing circumferential forces itself. If desired the blocks 1005 are disposed with, particularly if the arcuate pad 1004 is made from a relatively firm resilient elastomeric material. The shims 1006 may be dispensed with although they help prevent the resilient elastomeric material of the arcuate pad 1004 being extruded under pressure.

FIG. 16 shows another friction layer 1009" which comprises a perforate screen the exposed surface of which is coated with grit, preferably zircon grit. This arrangement has the advantage that any paint or dirt dislodged from the surface of the casing can be accommodated in the perforations of the screen. Because of the large number of holes in the perforate screen the perforate screen is preferably used in conjunction with a carrier plate 1008 to which it is preferably secured either by adhesive or by soldering or welding. It has also been found desirable to coat the surface of the perforate screen which faces the carrier plate with grit to enhance the transfer of forces therebetween. If desired the carrier plate could conceivably be dispensed with although this is not recommended.

FIG. 17 shows another friction layer 1009'" which is formed from expanded mesh which has been flattened between two rolls. Both surfaces of the expanded mesh have been coated with tungsten carbide grit, one to enhance gripping of the casing and the other to enhance gripping of the carrier plate 1008. As with the embodiment shown in FIG. 16, the spaces between the openings in the mesh can accommodate debris which might otherwise inhibit effective gripping of the casing. If desired the outer surface of the expanded mesh could be coated with tungsten carbide grit and the inner surface brazed or soldered to the carrier plate 1008.

The shims 1006 may be dispensed with. However, they do help redistribute any localized radial loads over the surface of the arcuate pad 1004. For extremely light loads the gripping arrangement 1007 may comprise a sheet of abrasive paper without a carrier plate 1008, but other embodiments may be more durable.

In use, the gripping arrangement 1007 can be rapidly replaced simply by unscrewing the socket screws 1014, removing the end plates 1012 and 1013 together with the gripping arrangement 1007 and installing a new arrangement. Because it is normally essential to minimize replacement time the gripping arrangement 1007 will normally be supplied complete with end plates 1012 and 1013. The gripping arrangement 1007 may be removably mounted on the end plates 1012 and 1013 if desired.

The present invention is useful for gripping casing for rotation. Gripping arrangements in accordance with the present invention may also be used for gripping and rotating other tubulars, for example tubing or drill strings, or for use in slips, for example for supporting a casing string or drill string while lengths are being added thereto or subtracted therefrom.

Figure 19A:
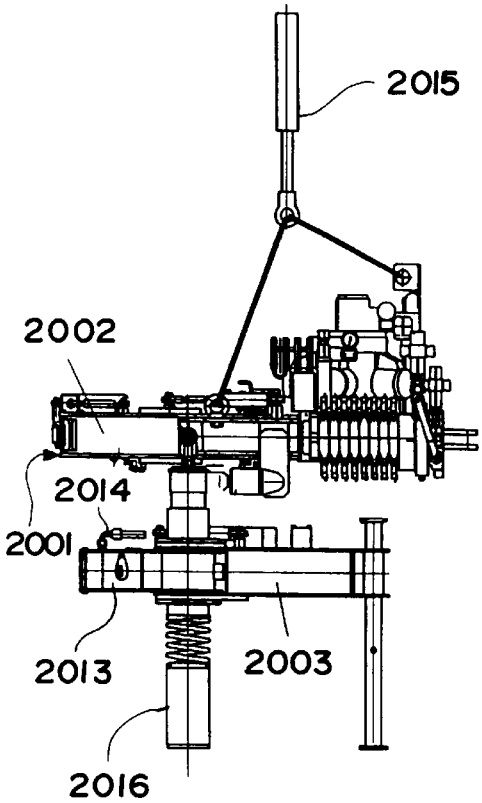
FIG. 19A is a side elevation of a conventional tong assembly.
Figure 19B:
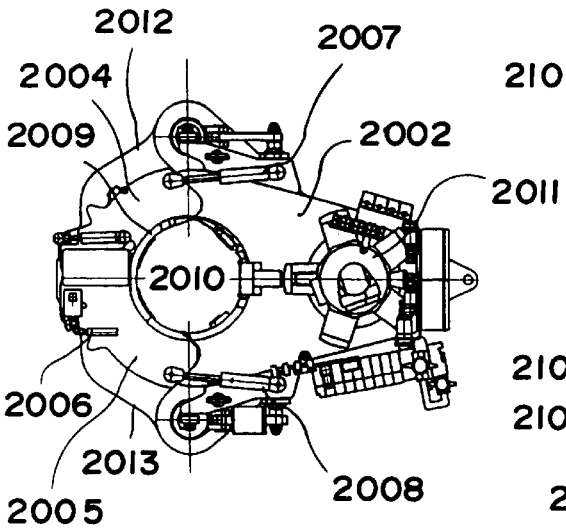
FIG. 19B is a top plan view of the tong assembly shown in FIG. 19A.

Referring to FIGS. 19A and 19B of the drawings there is shown a conventional tong assembly which is generally identified by the reference numeral 2001.

The tong assembly 2001 comprises a power tong 2002 and a backup tong 2003.

The power tong 2002 comprises a pair of gates 2004, 2005 which are held together in the position shown by latch 2006. When the latch 2006 is released the gates 2004, 2005 can be swung open by admitting hydraulic fluid to piston and cylinder assemblies 2007 and 2008. The power tong 2002 also contains a rotary 2009 which is provided with four jaw assemblies 2010. The rotary 2009 can be rotated by a hydraulic motor 2011.

The backup tong 2003 is provided with two gates 2012, 2013 which are held together by latch 2014 but which, when latch 2014 is released can be swung to an open position.

In use, a lower length of casing (not shown), the upper end of which is provided with a socket, is gripped by slips. A stabbing guide is mounted on the socket and the pin of an upper length of casing is lowered into the stabbing guide.

Once the pin is correctly located the stabbing guide is removed. The gates 2004, 2005 of the power tong 2002 and the gates 2012, 2013 of the backup tong 3 are then opened and the tong assembly 2001 moved towards the casing until the lower length of casing lies within the backup tong 2003 and the upper length of casing lies within the power tong 2002. The gates 2004, 2005, 2012, 2013 are then closed and latched. Jaw assemblies in the backup tong are then advanced to engage the lower length of casing while jaw assemblies in the power tong 2002 are advanced to grip the upper length of casing. The hydraulic motor 2011 is then actuated to turn the rotary 2009 and rotate the upper length of casing relative to the lower length of casing. The tong assembly 2001 is supported by a pneumatic lifting cylinder 2015 which enables the power tong 2002 to move towards the backup tong 2003 as the pin enters the socket. Reaction forces are transmitted by columns 2016 disposed to either side of the tong assembly 2001 and by a series of levers in a known manner. It should be noted that the power tong 2002 is free to move in a plane parallel to the backup tong 2003 within certain limits.

Figure 20A:
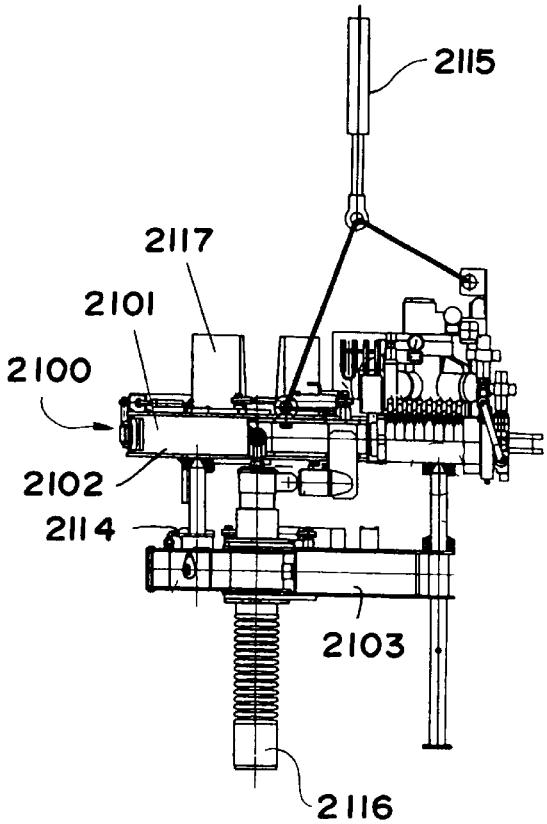
FIG. 20A is a side elevation of a first embodiment of an apparatus in accordance with the present invention.
Figure 20B:
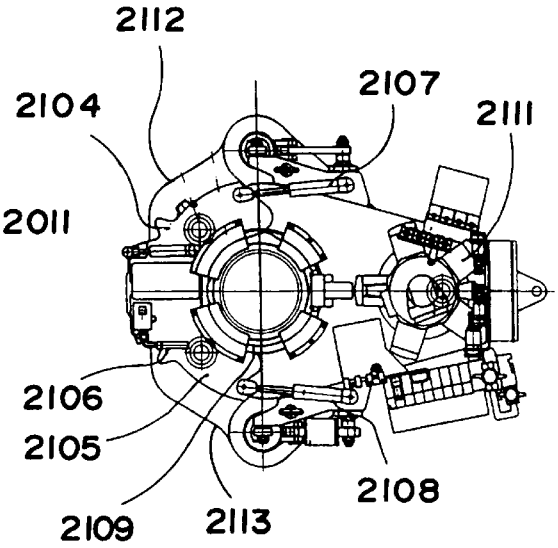
FIG. 20B is a top plan view of the apparatus shown in FIG. 20A.

Referring now to FIGS. 20A and 20B there is shown an apparatus in accordance with the present invention which is generally identified by the reference numeral 2100.

The apparatus 2100 comprises a tong assembly 2101 which is generally similar to the tong assembly 2001 shown in FIGS. 19A and 19B and parts of the tong assembly 2101 similar to the tong assembly 2001 have been identified by similar reference numerals in the "2100" series.

The main differences are that:

The top of the power tong 2102 is provided with a guide 2117;

The backup tong 2103 is provided with jaw assemblies for accurately positioning the lower casing with respect to the backup tong 2103; and Means are provided for accurately aligning the power tong 2102 with respect to the backup tong 2103 and hence the guide 2117 with the lower casing.

Figure 21A:
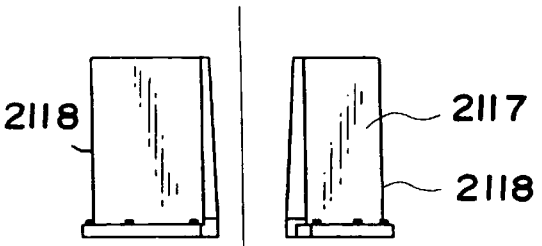
FIG. 21A is a side view of the components of a guide forming part of the apparatus shown in FIGS. 21A and 21B.
Figure 21B:
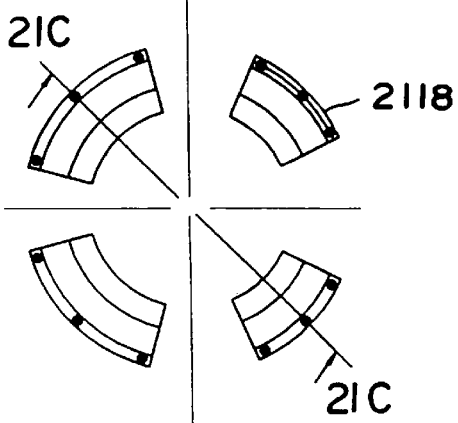
FIG. 21B is a top plan view of the guide shown in FIG. 21A.
Figure 21C:
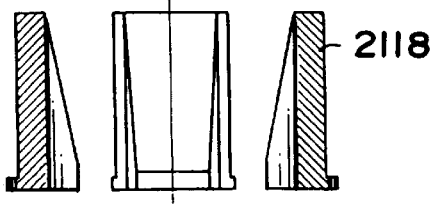
FIG. 21C is a section on line 21C—21C of FIG. 21B.

Turning first to the guide 2117 it will be seen from FIG. 21B that this comprises four identical components 2118 which are bolted to the top of the power tong 2102. As best shown in FIG. 21C each component is tapered so as to guide the pin of an upper casing to the center of the opening of the power tong 2102.

Figure 22:
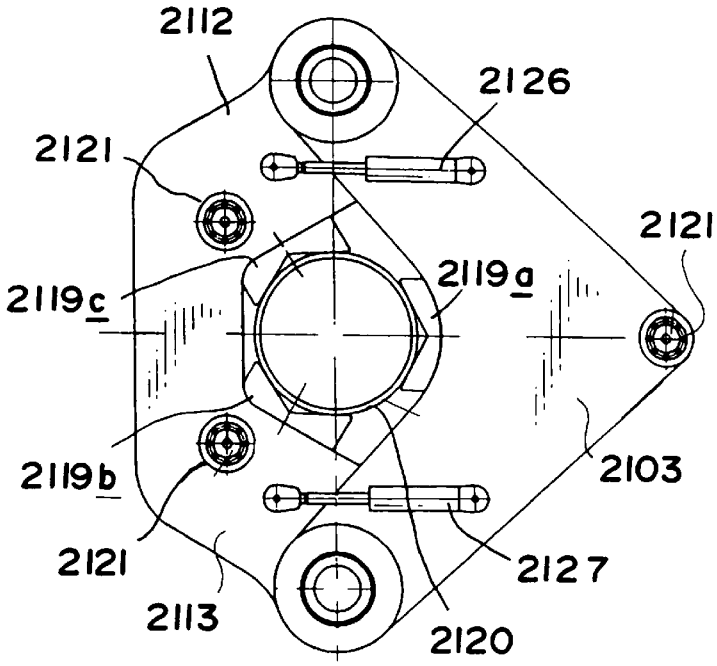
FIG. 22 is a top plan view of the backup tong forming part of the apparatus shown in FIGS. 20A and 20B with certain parts removed for clarity.

Referring now to FIG. 22, the backup tong 2103 is provided with three prismatic jaw assemblies 2119*a*, 2119*b*, and 2119*c* which, when actuated, hold a lower length of casing 2120 in a fixed position relative to the backup tong 2103.

As shown in FIG. 23 the backup tong 2103 is provided with three upwardly extending locating rods 2121 which are each provided with a conical tip 2122. Similar, the underside of the power tong 2102 is provided with three blocks 2123 each of which is provided with a recess 2124 shaped to receive the conical tip 2122 of a respective locating rod 2121.

In use, the lower length of casing 2120 is first secured by slips on the rig floor in the usual manner. The gates 2112 and 2113 of the backup tong 2103 are then opened and the tong assembly 2101 moved into position with the backup tong 2103 circumjacent the lower length of casing 2120 and immediately below the socket 2125 thereof.

The gates 2112 and 2113 are then closed by hydraulic piston and cylinder assemblies 2126 and 2127 and the latch 2114 closed. The prismatic jaw assembly 2119*a* is fixed while prismatic jaw assemblies 2119*b* and 2119*c* are automatically advanced by a predetermined distance when the latch 2114 is closed. This grips the lower length of casing firmly and also ensures that the backup tong 2003 is in a fixed position relative to the lower length of casing 2120. The position thus far attained is shown in FIG. 23.

At this time pneumatic lifting cylinder 2115 is extended which lowers the backup tong 2003. The conical tips 2122 of the locating rods 2121 enter the recesses 2124 of the blocks 2123 and thus locate the power tong 2002 with respect to the backup tong 2003. This in turn locates the guide 2117 with respect to the lower length of casing 2120 so that the center of the guide 2117 is coaxial with the axis of the lower length of casing 2120. This position is shown in FIG. 24.

At this time the upper length of casing 2128 is lowered into the proximity of the guide 2117. As shown in FIG. 25 the lower end of the upper length of casing 2128 is provided with a pin 2129 which is tapered.

As the upper length of casing 2128 is further lowered the pin 2129 enters the guide 2117 and is centered thereby. It then passes downwardly until it enters the socket 2125 as shown in FIG. 26.

The power tong 2102 is then raised so that the blocks 2123 are well clear of the locating rods 2121. At this point the jaw assemblies in the power tong 2102 are applied to the upper length of casing 2128 and the hydraulic motor 2111 actuated to rotate the rotary and screw the pin 2129 into the socket 2125. During the procedure the power tong 2102 moves towards the backup tong 2103. However, even when the joint is tightened to the required torque the blocks 2123 still lie a short distance above the conical tips 2122 of the locating rods 2121.

At this stage the jaw assemblies of both the power tong 2102 and the backup tong 2103 are relaxed, the gates 2104, 2105, 2112 and 2113 opened and the tong assembly 2101 retracted in preparation for the casing being lowered. It will be noted that one component 2118 of the guide 2117 is mounted on each of the gates 2104, 2105 and accordingly the guide 2117 opens and closes with the gates 2104, 2105.

For certain applications a backup tong is not required, for example where the power tong can conveniently be restrained by a chain attached to the drilling tower.

FIG. 28 shows an apparatus in accordance with the present invention which is generally identified by the reference numeral 2200.

The apparatus 2200 comprises a power tong 2202 which is generally similar to the power tong 2002. The basic construction of the power tong 2202 is similar to the power tong 2002 and parts having similar functions have been identified by the same reference numeral in the "2200" series.

The main differences are that the apparatus 2200 does not include a backup tong and that it is provided with a guide 2217 and a socket centralizer 2230.

In use, the lower length of casing 2220 is first secured by slips (not shown) with the socket 2225 facing upwardly close to the slips. The power tong 2202 is then lowered onto the socket 2225 so that the socket 2225 enters the socket centralizer 2230 and aligns the socket centralizer 2230, the socket 2225 and the guide 2217. The upper length of casing 2228 is then lowered so that its pin 2229 enters the guide 2217, is center there by and enters the socket 2225. At this point power tong 2202 is raised. Its jaw assemblies are then advanced to grip the upper length of casing 2228 which is then rotated to screw the pin 2229 into the socket 2225. Once the joint is tightened to the required torque the gates 2204, 2205 are opened and the power tong 2202 withdrawn.

The embodiment shown in FIG. 29 is generally similar to that shown in FIG. 28 except that the apparatus 2300 also includes a backup tong 2303. Since the upper length of casing 2328 and the lower length of casing 2320 are being aligned by the guide 2317 and the socket centralizer 2330 no special arrangements need be made for aligning the power tong 2302 and the backup tong 2303.

The procedure for connecting the upper length of casing 2328 to the lower length of casing 2320 is as follows. First, the lower length of casing 2320 is secured in slip (not shown). The gates 2312, 2313 of the backup tong are then opened and the apparatus 2300 maneuvered so that the lower length of casing 2320 is disposed within the backup tong 2303. The power tong 2302 is then lowered until the socket 2325 on the lower length of casing 2320 is received within the socket centralizer 2330. The upper length of casing 2328 is then lowered until the pin 2329 passes through guide 2317 and enters the socket 2328. Only at this stage are gates 2312, 2313 closed and the jaw assemblies of the backup tong 2303 activated to grip the lower length of casing 2320. The power tong 2302 is then raised and its jaw assemblies activated to grip the upper length of casing 2328 which is then rotated to cause the pin 2329 to enter the socket 2325 and the joint to be tightened to the desired torque. The jaw assemblies are then relaxed and the gates 2304, 2305, 2312, 2313 of the power tong 2302 and the backup tong 2303 opened prior to retracting the apparatus 2300.

Various modifications to the embodiments described are envisaged, for example, if desired, the guide and the socket centralizer could be mounted on the backup tong 2303 rather than the power tong 2302. Alternatively, the guide could be mounted on the backup tong without a socket centralizer. Such an arrangement is shown in FIG. 30.

The embodiment shown in FIG. 30 is generally similar to that shown in FIG. 19*a* and 19*b* and parts of the tong assembly 2401 similar to the tong assembly 2001 have been identified by similar reference numerals in the "2400" series. One difference is that the top of the backup tong 2403 is provided with a guide 2417.

In use, the lower length of casing 2420 is first secured by stops 2431 on the rig floor in the usual manner. The gates 2412 and 2413 of the backup tong 2403 are then opened. Since two of the four components 2418 of the guide 2417 are mounted on the gates 2412 and 2413 the guide 2417 opens with the gates 2412 and 2413 so that the lower length of casing 2420 can enter the backup tong 2403 when the carriage 2432 which supports the apparatus 2400 is advanced towards the casing 2420 on rails 2433. When the lower length of casing 2420 is fully within the backup tong 2403 the gates 2412 and 2413 are closed. The components 2418 of the guide 2417 have a stepped interior (not visible in FIG. 30) so that the lower part of each component 2418 touches the socket on the top of the lower length of casing 2420 whilst the upper part of the interior of each component 2418 tapers inwardly to form a funnel. Once the lower length of casing 2420 has been gripped the upper length of casing 2428 is lowered through the power tong 2402 towards the lower length of casing 2420. The guide 2417 guides the pin on the bottom of the upper length of casing 2428 into the socket. The power tong 2402 is disposed a small distance above the guide 2417. Once the pin of the upper length of casing 2428 has entered the socket on the lower length of casing the jaws of the power tong 2402 are applied to the upper length of casing 2428 which is rotated until the joint reaches the desired torque.

Thereafter, gates 2404, 2405, 2412, 2413 are opened and the assembly 2400 retracted on the carriage 2432.

Referring to FIGS. 31 to 37 of the drawings there is shown a rotary which is generally identified by the reference numeral 3100.

The rotary 3100 is fitted with a jaw assembly 3101 which comprises two jaw units 3102 which are pivotally mounted on a pivot shaft 3103 and which are biased apart by a spring 3104.

Each jaw unit 3102 comprises a jaw holder 3105 on which is mounted a jaw 3106 the radially inner surface of which is provided with a plurality of gripping elements 3107 which together define a gripping surface which is substantially arcuate.

The jaw holders 3105 are provided with an arcuate track 3108 and the jaw 3106 is slidably mounted on the arcuate track 3108 so that the jaws 3106 can slide along the arcuate track 3108 relative to the jaw holder 3105.

Thus, when the jaw holders 3105 are in the position shown in FIGS. 31 to 37 the jaws 3106 can slide along an arcuate path having a center of curvature at a point 3109 which is radially inwardly of the gripping surface of the gripping elements 3107 but to one side of the center 3110 of the rotary 3100.

Figure 31:
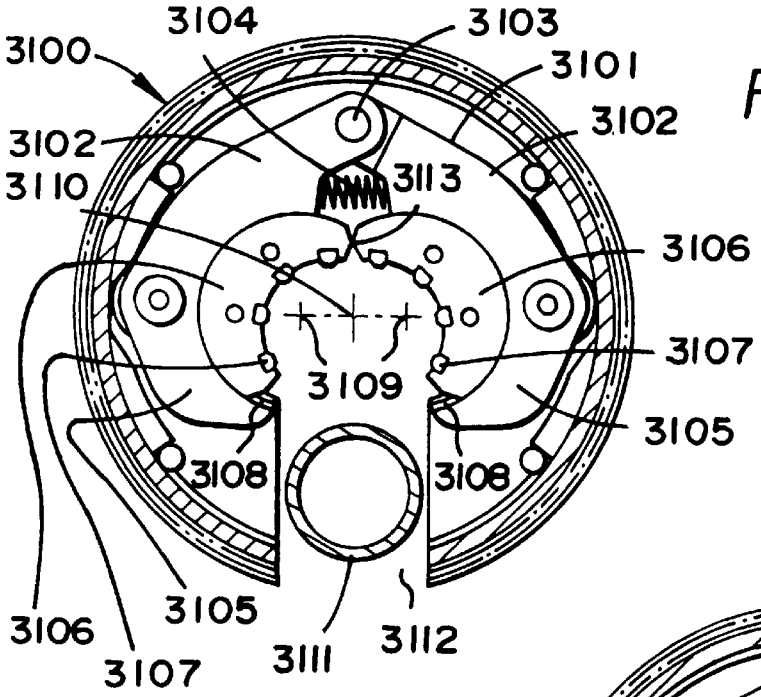
FIG. 31 is a schematic plan view, partly in section, showing a rotary fitted with a jaw assembly in accordance with the present invention ready to receive a tubular.

In use, when it is desired to grip a tubular 3111, for example a length of casing, the tubular 3111 is introduced into the rotary 3100 through the opening 3112. This is shown in FIG. 31. It should be noted that the jaws 3106 have been displaced to a position where they touch one another at point 3113. This position can be achieved by displacing the jaws 3106 manually. However, in practice the jaws 3106 will normally be found in this position as a result of the exit of the previous tubular as will be described more fully hereinafter.

Figure 32:
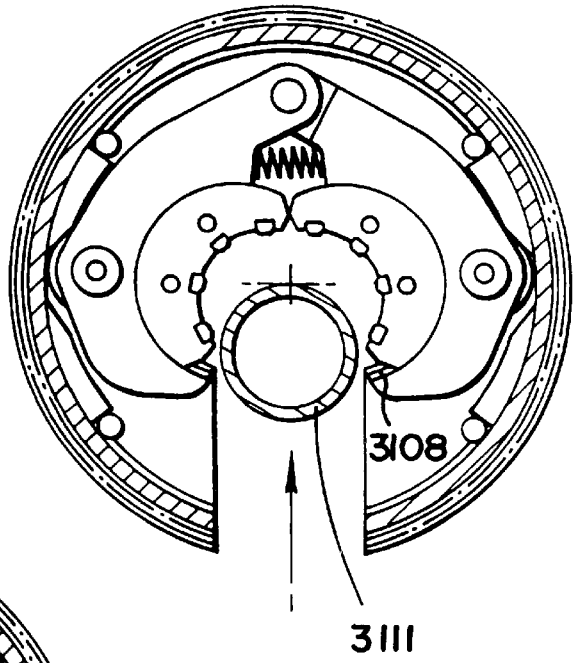
FIG. 32 shows the tubular entering the jaw assembly.

FIG. 32 shows the tubular 3111 entering the jaw assembly 3101, it will be noted that part of the arcuate track 3108 is visible.

Figure 33:
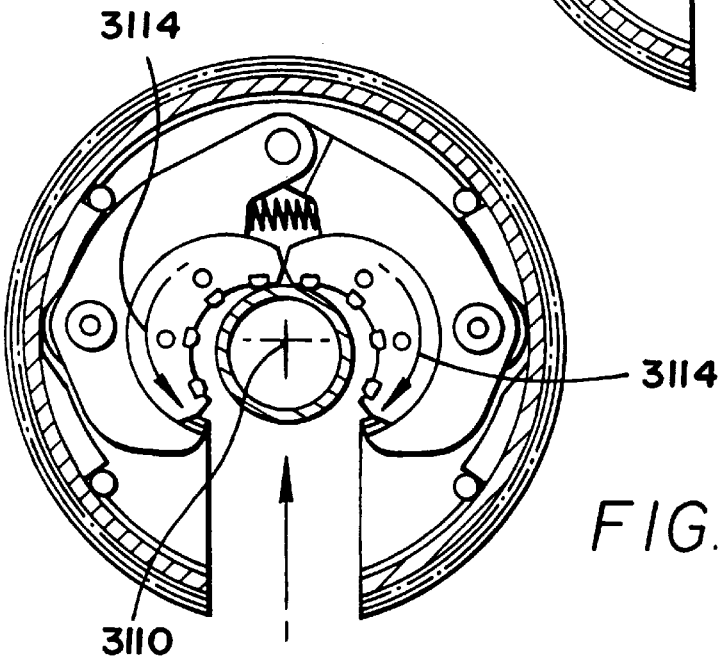
FIG. 33 shows the tubular nearing its final position in the jaw assembly.
Figure 34:
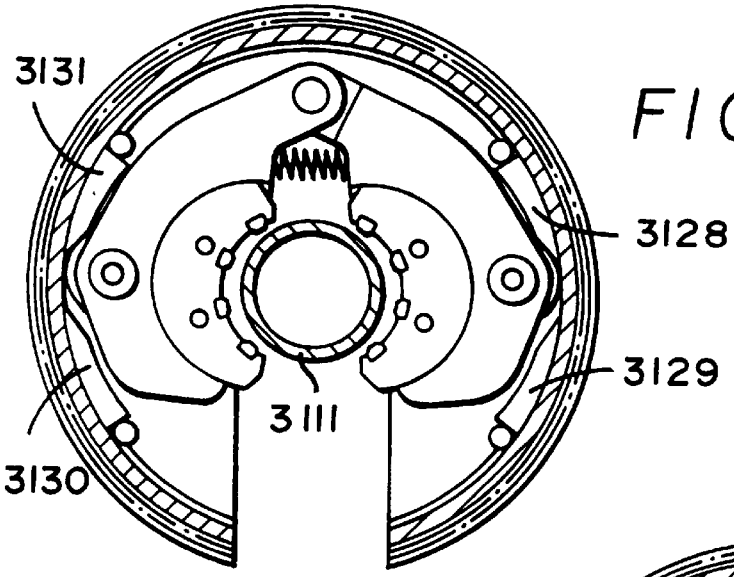
FIG. 34 shows the tubular in its final position.
Figure 35:
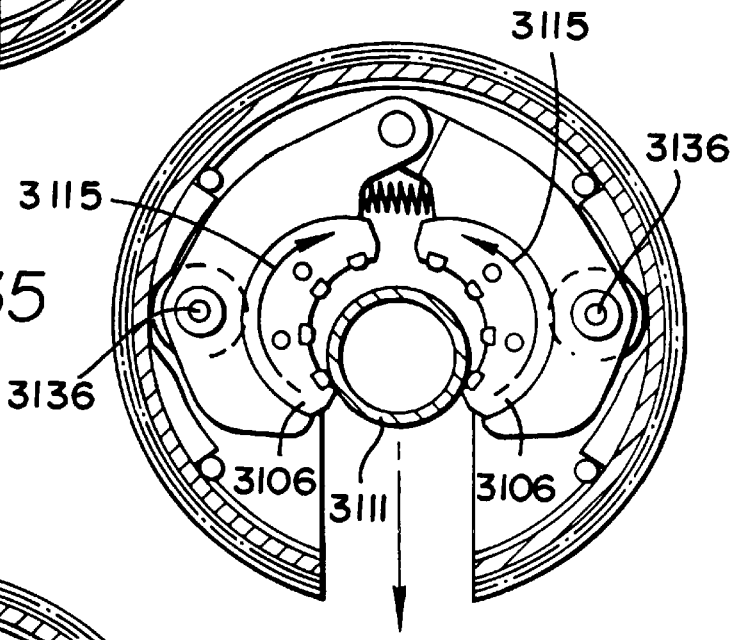
FIG. 35 shows the tubular being released from the jaw assembly.
Figure 36:
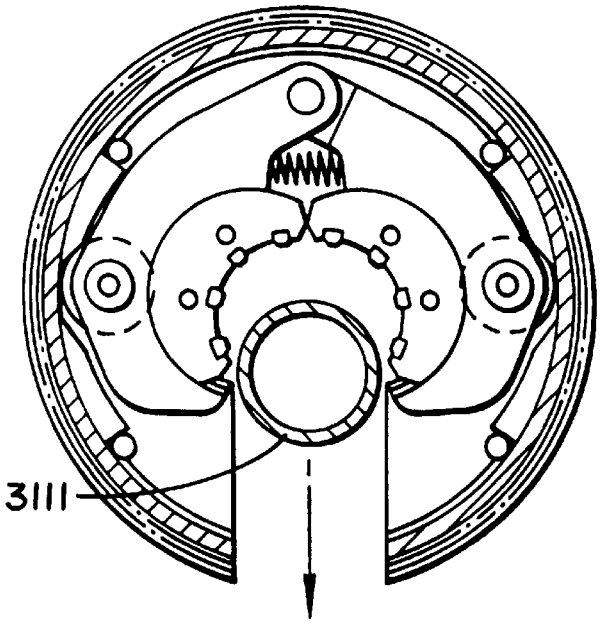
FIG. 36 shows the tubular leaving the jaw assembly.

FIG. 33 shows the tubular 3111 contacting the jaws 3106. As the tubular 3111 is further advanced towards the center 3110 of the rotary 3100 the jaws 3106 are displaced in the direction of the arrows 3114 until they come to rest in the position shown in FIG. 34. It will be noted that the arcuate track 3108 is no longer visible.

The rotary 3100 is then rotated clockwise (as viewed in FIG. 34) to advance the jaws 3106 into gripping engagement with the tubular 3111 as will be described herein after. The gripping surface substantially conforms to the surface of the tubular 3111 and thus has a center of curvature at the center 3110 of the rotary 3100 when the jaws 3106 are applied. After the tubular 3111 has been rotated and tightened to the required torque the rotary 3100 is rotated anti-clockwise to allow the jaws 3106 to move away from the tubular 3111 under the influence of spring 3104.

The tubular 3111 is then moved towards the opening 3112. As it moves it engages the jaws 3106 and displaces them in the direction of the arrows 3115 so that they occupy the position shown in FIG. 36 which is identical to FIGS. 31, 32 and 37.

Figure 37:
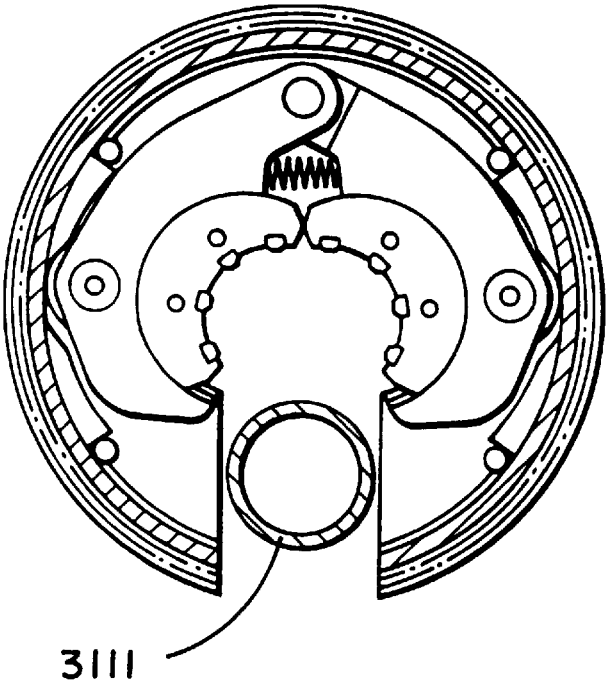
FIG. 37 shows the tubular leaving the rotary.

FIG. 37 shows the tubular 3111 leaving the rotary 3100.

It will be appreciated that the jaw assembly 3101 is extremely simple, quick to use and relatively inexpensive to manufacture and maintain.

Figure 39:
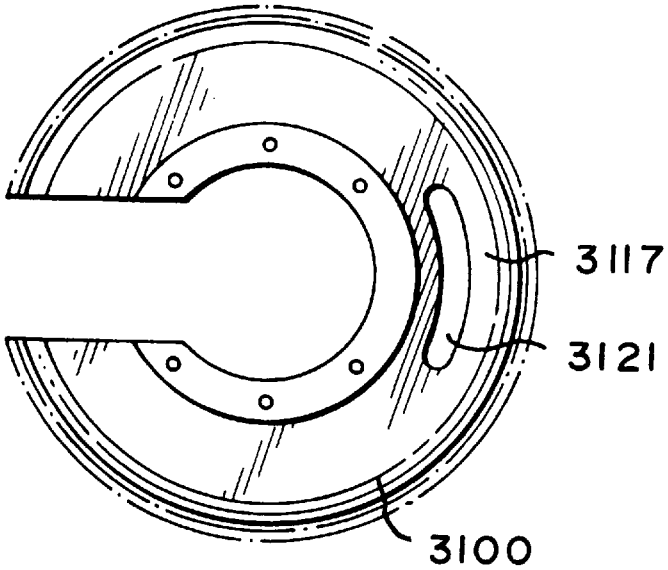
FIG. 39 is a top plan view of the rotary which forms part of the tong shown in FIG. 38.
Figure 40:
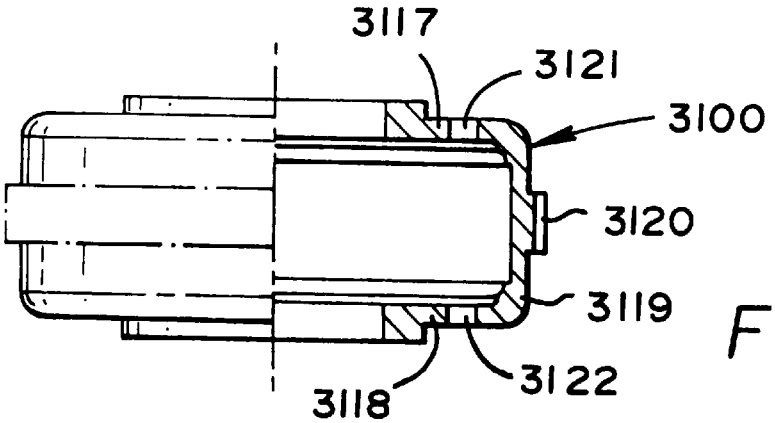
FIG. 40 is a side view, partly in cross-section and partly in elevation, showing the rotary of FIG. 39.
Figure 38:
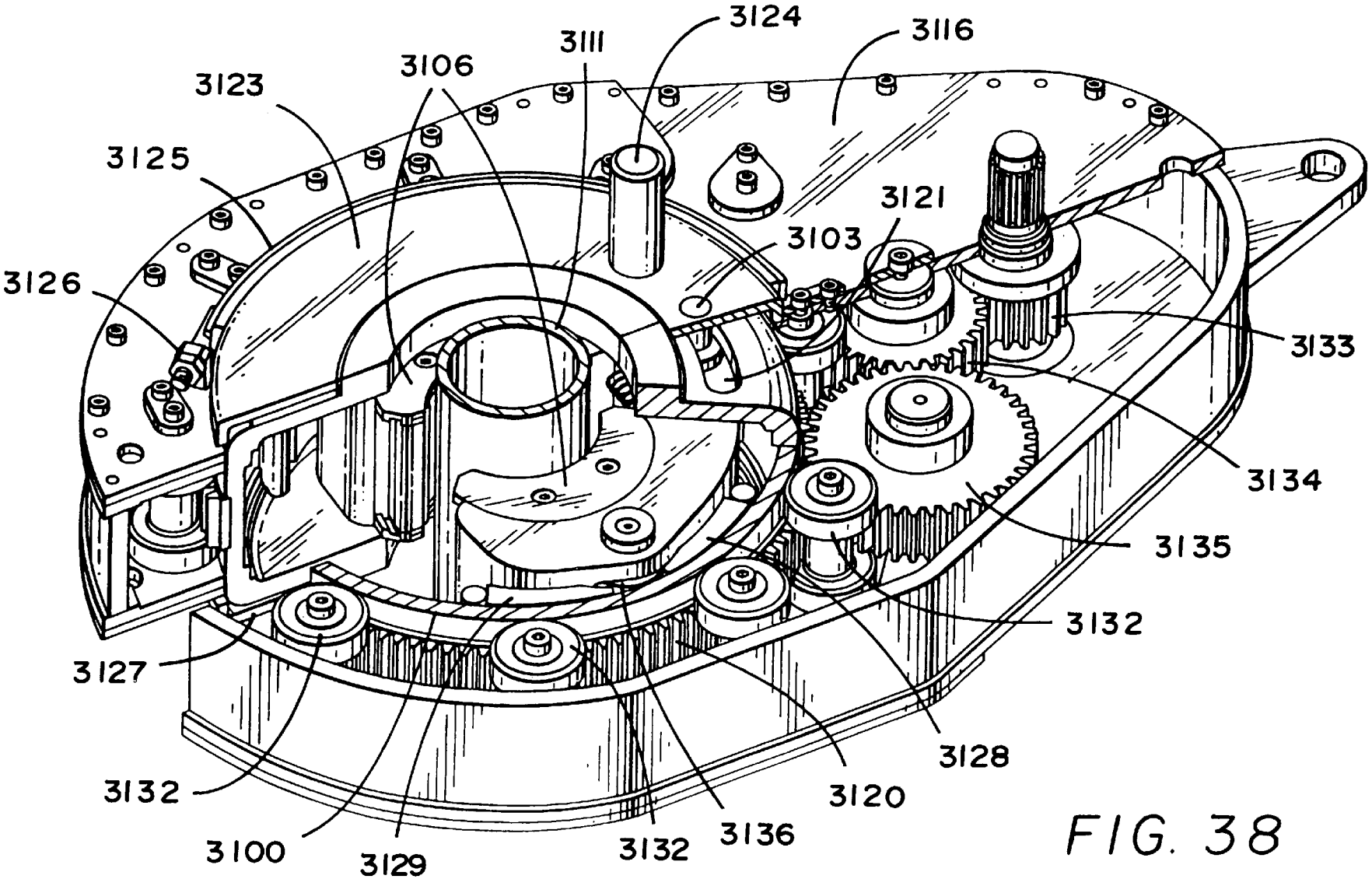
FIG. 38 is a perspective view, with part cut away, showing a tong in accordance with the present invention.

Referring now to FIG. 38, the rotary 3100 is shown fitted in a tong 3116. As shown in FIG. 39 and 40, the rotary 3100 is formed as a one piece casting which comprises a top section 3117, a bottom section 3118, and a peripheral wall 3119 on which is formed a toothed track 3120. Both the top section 3117 and the bottom section 3118 are provided with an elongate slot 3121, 3122 respectively. Each elongate slot 3121, 3122 has its center of curvature on the center of rotation of the rotary 3100.

As can be seen from FIG. 38, the upper part of the pivot shaft 3103 which forms the pivot point for the two jaw units 3102 projects upwardly through the elongate slot 3121 while the lower part of the pivot shaft 3103 projects downwardly through the elongate slot 3122.

The upper part of the pivot shaft 3103 is secured to a disk 3123 which is provided with a handle 3124.

A friction member 3125 extends circumjacent the disk 3123 and is held thereagainst by a tensioner 3126.

A disk 3127 similar to disk 3123 is mounted below the rotary 3100 and is also engaged by a second friction member similar to friction member 3125.

As can be seen in FIG. 38 and FIGS. 31 to 37, the sides of the rotary 3100 are provided with cams 3128, 3129, 3130 and 3131 which are screwed to the rotary 3100. The rotary 3100 is located in the tong 3116 by nine guide rolls 3132, five of which are visible in FIG. 38. The guide rolls 3132 each have an upper and a lower roller which bears against the peripheral wall 3119 of the rotary 3100 above and below the toothed track 3120 respectively.

The rotary 3100 is driven by a hydraulic motor (not shown) which acts through a gear train which includes gear wheels 3133, 3134 and 3135.

In FIG. 38 the tubular 3111 is about to be gripped. (This corresponds to the position shown in FIG. 34.) The hydraulic motor (not shown) is actuated to rotate gear wheels 3133, 3134 and 3135 which in turn rotate the rotary 3100 in a clockwise direction. However, while the rotary 3100 rotates the disk 3123 is restrained by the friction member 3125. The disk 3123 in turn restrains the pivot shaft 3103 and the jaw assembly 3101. Because the jaw assembly 3101 is restrained the jaw units 3102 ride up on the cams 3128, 3130 which urge the jaws 3106 into the tubular 3111 until either the pivot shaft 3103 engages the end of the elongate slot 3121 (or the forces between the tubular 3111, the jaw units 3102 and the cams 3128, 3130 are sufficiently high) at which time the disk 3123 rotates in unison with the rotary 3100 against the friction member 3125. It will be noted that because the centers of curvature of the gripping elements 3107 and the arcuate track 3108 do not coincide the jaw holders 3105 do not spin around the jaws 3106 although means to limit the sliding movement of the jaws 3102 relative to their jaw holders 3105 could be provided if desired.

When the tubular 3111 has been tightened to the desired torque the hydraulic motor is reversed to rotate the rotary 3100 anti-clockwise. The jaws 3106 are normally firmly engaged in the tubular 3111 and hence the rotary 3100 rotates relative to the jaw assembly 3101 so that the jaw holder 3105 returns to the position shown in FIG. 38. Means may be provided to prevent the jaw holders 3105 engaging the cams 3129 and 3131.

It will be noted that the jaw holders 3105 are each provided with a roller 3136 which engages the cams 3128, 3129, 3130 and 3131.

If it is desired to rotate the tubular 3111 in the opposite direction then the rotary 3100 is simply rotated in the opposite direction causing the rollers 3136 to roll along the cams 3129, 3131.

It will be noted that the entire jaw assembly 3101 can be removed from the rotary 3100 by simply removing the pivot shaft 3103 and withdrawing the jaw units 3102. The cams 3128, 3129, 3130, 3131 can then be readily replaced if desired and the jaw units 3102 refitted or replaced if desired. Such changes would generally be made when changing the diameter of the tubular being run.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. A tong for rotating tubulars in wellbore operations, the tong comprising a tong outer case, a rotary movably mounted in the case for rotating a tubular, apparatus for rotating the rotary to rotate the tubular, at least one jaw movably mounted in the case and movable by the rotary for gripping the tubular, the at least one jaw having a gripping insert thereon, the gripping insert having a smooth surface for contacting the tubular, and pre-load apparatus interconnected between the at least one jaw and the rotary for applying a pre-load to the at least one jaw so that slipping of the at least one jaw on the tubular is reduced and damage to the tubular by the at least one jaw is reduced.

2. The tong of claim 1 further comprising at least one jaw immovably secured to the rotary for facilitating the gripping of the tubular.

3. The tong of claim 1 further comprising the pre-load apparatus further comprising a piston/cylinder assembly with a hollow cylinder and a piston movable therein in response to fluid moving therein or therefrom, a rod secured to the piston and with a rod portion extending from the hollow cylinder, and the hollow cylinder secured to the rotary and the rod portion secured to the at least one movable jaw so that selective retraction of the rod portion moves the at least one movable jaw to apply the pre-load thereto.

4. The tong of claim 3 further comprising at least one jaw immovably secured to the rotary for facilitating the gripping of the tubular.

5. The tong of claim 1 further comprising a first jaw immovably secured to the rotary for facilitating the gripping of the tubular, and a second jaw immovably secured to the rotary for facilitating the gripping of the tubular.

6. The tong of claim 5 further comprising the pre-load apparatus further comprising a piston/cylinder assembly with a hollow cylinder and a piston movable therein in response to fluid moving therein or therefrom, a rod secured to the piston and with a rod portion extending from the hollow cylinder, and the hollow cylinder secured to the rotary and the rod portion secured to the at least one movable jaw so that selective retraction of the rod portion moves the at least one movable jaw to apply the pre-load thereto.

7. The tong of claim 6 further comprising a power system for selectively activating the pre-load apparatus and selectively controlling the application of a pre-load to the at least one jaw movably mounted in the case, and a control system having a control valve for permitting fluid to flow from a fluid reservoir under pressure to the piston/cylinder assembly and for selectively permitting fluid from the piston/cylinder assembly to flow back to the fluid reservoir.

8. The tong of claim 1 further comprising a power system for selectively activating the pre-load apparatus and selectively controlling the application of a pre-load to the at least one jaw movably mounted in the case.

9. The tong of claim 1 wherein the tong is a power tong with power apparatus for rotating the rotary, the rotary interconnected with the power apparatus.

10. The tong of claim 1 further comprising an insert holder to which the gripping insert is connected, the insert holder connected to the at least one jaw movably mounted in the case.

11. The tong of claim 10 wherein the insert is releasably connected to the insert holder.

12. The tong of claim 10 wherein the insert holder is releasably connected to the at least one jaw.

13. The tong of claim 1 wherein the pre-load apparatus is manually operable to apply a pre-load to the at least one jaw movably mounted in the case.

14. The tong of claim 1 wherein the gripping insert is flexible for conforming to an exterior shape of the tubular.

15. The tong of claim 1 further comprising aligning apparatus for aligning the tubular, the aligning apparatus comprising a guide mounted on a top of the tong case for guiding the tubular from above into the tong.

16. The tong of claim 1 further comprising a jaw holder, the at least one jaw slidably mounted on said jaw holder.

* * * * *